US010875687B2

(12) United States Patent
Lewis et al.

(10) Patent No.: US 10,875,687 B2
(45) Date of Patent: Dec. 29, 2020

(54) PLASTIC CONTAINER WITH INTEGRATED SPOUT FOR DIRECTIONAL POUR

(71) Applicant: GRAHAM PACKAGING COMPANY, L.P., Lancaster, PA (US)

(72) Inventors: Benton A. Lewis, Manchester, PA (US); Brian Hagan, York, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 174 days.

(21) Appl. No.: 15/799,614

(22) Filed: Oct. 31, 2017

(65) Prior Publication Data

US 2018/0118424 A1 May 3, 2018

Related U.S. Application Data

(63) Continuation of application No. PCT/US2017/058988, filed on Oct. 30, 2017.

(60) Provisional application No. 62/415,365, filed on Oct. 31, 2016, provisional application No. 62/448,555, filed on Jan. 20, 2017.

(51) Int. Cl.

| | |
|---|---|
| ***B65D 47/12*** | (2006.01) |
| ***B65D 51/22*** | (2006.01) |
| ***B65D 41/26*** | (2006.01) |
| ***B65D 25/42*** | (2006.01) |

(52) U.S. Cl.

CPC ..... *B65D 47/123* (2013.01); *B65D 25/42* (2013.01); *B65D 41/265* (2013.01); *B65D 51/228* (2013.01); *B65D 2401/15* (2020.05)

(58) Field of Classification Search

CPC .... B65D 47/123; B65D 47/122; B65D 47/12; B65D 47/06; B65D 47/04; B65D 47/00; B65D 25/42; B65D 25/40; B65D 25/38; B65D 41/265; B65D 41/26; B65D 51/228

See application file for complete search history.

(56) References Cited

U.S. PATENT DOCUMENTS

24 A * 9/1839 Clark ..... B27F 5/02 144/75
2,035,877 A * 3/1936 Geerlings ..... B65D 1/08 215/43

(Continued)

FOREIGN PATENT DOCUMENTS

WO WO 2004/065249 A1 8/2004

OTHER PUBLICATIONS

International Search Report dated Jan. 24, 2018 in International Application No. PCT/US17/58988.

*Primary Examiner* — Steven A. Reynolds
*Assistant Examiner* — Javier A Pagan
(74) *Attorney, Agent, or Firm* — Baker Botts L.L.P.

(57) ABSTRACT

Plastic container comprises a main body portion defining an interior space; and a finish portion defining a mouth in fluid communication with the interior space, the finish portion having an upper portion including a circumferential wall surrounding the mouth, the circumferential wall having a lower end and an upper edge defining a height of the circumferential wall, the circumferential wall comprising a first indent and a second indent each extending inwardly into the mouth to form a spout portion disposed between the first indent and the second indent, the upper portion further comprising at least one thread disposed on the height of the circumferential wall.

19 Claims, 27 Drawing Sheets

(56) References Cited

U.S. PATENT DOCUMENTS

| | | | | | |
|---|---|---|---|---|---|
| 4,630,761 | A * | 12/1986 | Thomson | B65D 47/122 | 215/329 |
| 5,881,894 | A * | 3/1999 | Gargano | B65D 41/26 | 141/381 |
| 6,085,949 | A * | 7/2000 | Zimny | B65D 1/023 | 222/564 |
| 6,460,726 | B1 * | 10/2002 | Hierzer | B65D 47/0809 | 215/235 |
| 8,714,417 | B1 * | 5/2014 | Szekely | B65D 1/10 | 222/572 |
| 2002/0195471 | A1 * | 12/2002 | Nottingham | B01F 15/00733 | 222/570 |
| 2004/0065249 | A1 * | 4/2004 | Williams | B60Q 1/2665 | 116/35 R |
| 2007/0241141 | A1 * | 10/2007 | Maki | B65D 17/4011 | 222/570 |
| 2010/0213211 | A1 * | 8/2010 | Whaling | B65D 41/56 | 222/111 |
| 2011/0204099 | A1 * | 8/2011 | Piscopo | B65D 1/023 | 222/111 |
| 2013/0105432 | A1 * | 5/2013 | Paredes | B65D 23/102 | 215/40 |

* cited by examiner

PLASTIC CONTAINER WITH INTEGRATED SPOUT FOR DIRECTIONAL POUR

CROSS REFERENCE TO RELATED APPLICATIONS

This application is a continuation of International Patent Application No. PCT/US2017/058988, filed on Oct. 30, 2017, which claims priority to U.S. Provisional Patent Application Ser. No. 62/415,365, filed on Oct. 31, 2016, and U.S. Provisional Patent Application Ser. No. 62/448,555, filed on Jan. 20, 2017, the entire contents of each of which are incorporated herein by reference in their entirety.

BACKGROUND

Technical Field

The disclosed subject matter relates to plastic containers having directional pour designs including integrated spouts.

Description of Related Art

Plastic containers are well known and widely used for a variety of applications, including the storage, shipment and sale of various liquid products. Such plastic containers provide numerous advantages over containers made of glass, metals and/or composites. In many applications, it can be desirable to provide directional pour to allow a liquid or similar flowable product to flow from the container to a desirable location, such as a dose cup. Such liquids can include medicines, beverages, personal hygiene products, beauty products, and household and industrial cleaning liquids, including detergents, solvents, disinfectants, and polishes. Traditionally, a separate spout component is provided to be assembled to the container or bottle, adding operations and cost to the package.

Furthermore, containers with a separate spout component typically must be sealed, such as by a foam liner along the seam and/or mouth of the container to prevent leakage. The traditional compression foam liners can leak over time, particularly if containers holding liquid products are not positioned upright. This issue is particularly relevant with the advent of individual sales (e.g., online sales), wherein packages often may not be maintained in an upright position, resulting in leakage during handling and shipping. Therefore, it can be desirable to provide a more robust construction for the container with directional pour that is capable of being sealed and will hold up to shipping and handling conditions.

There thus remains a continued need for improved containers with directional pour capability for dispensing a liquid or similar flowable product. There further remains a need for such containers that can allow for robust sealing to prevent leaking during shipping and handling.

SUMMARY

The purpose and advantages of the disclosed subject matter will be set forth in and are apparent from the description that follows, as well as will be learned by practice of the disclosed subject matter. Additional advantages of the disclosed subject matter will be realized and attained by the subject matter particularly pointed out in the written description and claims hereof, as well as from the appended drawings.

To achieve these and other advantages and in accordance with the purpose of the disclosed subject matter, as embodied herein and broadly described, the disclosed subject matter includes a plastic container, comprising a main body portion defining an interior space, and a finish portion defining a mouth in fluid communication with the interior space. The finish portion has an upper portion including a circumferential wall surrounding the mouth, and the circumferential wall has a lower end and an upper edge defining a height of the circumferential wall. In addition, the circumferential wall comprises a first indent and a second indent each extending inwardly into the mouth to form a spout portion disposed between the first indent and the second indent. The upper portion further comprises at least one thread disposed on the height of the circumferential wall.

The finish portion can be unitary with the main body portion. The upper edge defines a flat planar surface about an entirety of the circumferential wall. The main body portion can have a bottom support surface defining a reference plane, the flat planar surface being parallel with the reference plane.

As embodied herein, the plastic container can further comprise an induction seal secured to upper edge of the circumferential wall. The induction seal can extend over at least one of the first indent and the second indent so as to expose a lower surface of the induction seal.

In accordance with another aspect of the disclosed subject matter, the finish portion further includes a bottom portion, and the bottom portion includes a flange surface extending outwardly from the lower end of the circumferential wall. A cap can be removably attached to the finish portion by the at least one thread on the circumferential wall, and the cap can have a bottom edge configured for engagement with the flange surface.

In accordance with another aspect of the disclosed subject matter. The bottom portion of the finish portion can further comprise a sidewall extending downwardly from the flange surface, and the sidewall of the bottom portion can include at least one retention lug. An overcap can be removably attached to the finish portion by at least one retention lug, and a cap can be further attached to the finish portion by at least one thread and disposed within the overcap.

As embodied herein, the circumferential wall of the plastic container is defined by a diameter of between about 1 inch and about 10 inches.

As embodied herein, at least a portion of at least one thread can be disposed on the spout portion of the plastic container. Alternatively or additionally, the first indent and the second indent can be free of any portion of the at least one thread, or at least a portion of the at least one thread can be disposed on the first indent or the second indent. As embodied herein, at least one thread can extend continuously about an entirety of a circumference of the circumferential wall of the upper portion or at least one thread can be interrupted along the circumferential wall of the upper portion. As embodied herein, at least one of the first indent and second indent can be not adjacent to the upper edge of the circumferential wall. The spout portion can include a lip extending outwardly from the circumferential wall.

In accordance with another aspect of the disclosed subject matter, a dose cap can be configured to be removably attached to the finish portion. In addition, the dose cap can comprise an outer portion with at least one inner thread to engage the at least one thread of the finish portion, and an inner hollow portion configured to extend through the mouth when the dose cap is attached to the finish portion.

In accordance with another aspect of the disclosed subject matter, the disclosed subject matter includes a plastic container, comprising a main body portion defining an interior space, and a finish portion defining a mouth in fluid communication with the interior space. The finish portion has an upper portion including a generally circumferential wall surrounding the mouth, and the circumferential wall has an upper edge defining a continuous, closed-loop flat planar surface. In addition, the circumferential wall comprises a first indentand a second indent each extending inwardly into the mouth to form a spout portion disposed between the first indent and the second indent.

It is to be understood that both the foregoing general description and the following detailed description and drawings are examples and are provided for purpose of illustration and are not intended to limit the scope of the disclosed subject matter in any manner.

The accompanying drawings, which are incorporated in and constitute part of this specification, are included to illustrate and provide a further understanding of the devices of the disclosed subject matter. Together with the description, the drawings serve to explain the principles of the disclosed subject matter.

BRIEF DESCRIPTION OF THE DRAWINGS

The subject matter of the application will be more readily understood from the following detailed description when read in conjunction with the accompanying drawings, in which:

FIGS. 2A-2H are a series of enlarged schematic views of the finish portion with a flat planar upper edge surface as depicted in the exemplary plastic container in FIG. 1, wherein FIG. 2A is a perspective view taken generally from the front of the container, FIG. 213 is a perspective view taken generally from the rear of the container, FIG. 2C is a top view, FIG. 2D is a rear view and FIG. 2E is an enlarged detail view of the thread of FIG. 2D, FIG. 2F is a side view, and FIG. 2G is a front view, and FIG. 2H is an enlarged detail view of the retention lug of FIG. 2G.

FIG. 3A is a perspective view, FIG. 3B is a side view, and FIG. 3C is a top view.

FIGS. 4A-4D are schematic views of an exemplary finish portion of a plastic container, with an induction seal attached to flat planar upper edge surface, wherein FIG. 4A-4B are perspective views of the exemplary finish portion from the front, FIG. 4C is a perspective view of the finish portion of FIGS. 4A-4B having an overcap attached to the finish portion, and FIG. 4D is a cross-sectional side view taken along the plane defined by line 4D-4D of the exemplary finish portion and overcap of FIG. 4C, and with an optional inner cap disposed over the induction seal and within the overcap.

FIG. 5A is a perspective view for the front and FIG. 5B is a top view.

FIG. 6A is a perspective view and FIG. 6B is a top view.

FIG. 7A is a perspective view and FIG. 7B is a top view.

FIG. 8A is a perspective view, FIG. 8B is a side view, and FIG. 8C is a top view.

FIG. 9A is a perspective view and FIG. 9B is a top view.

DETAILED DESCRIPTION

Figure 1:
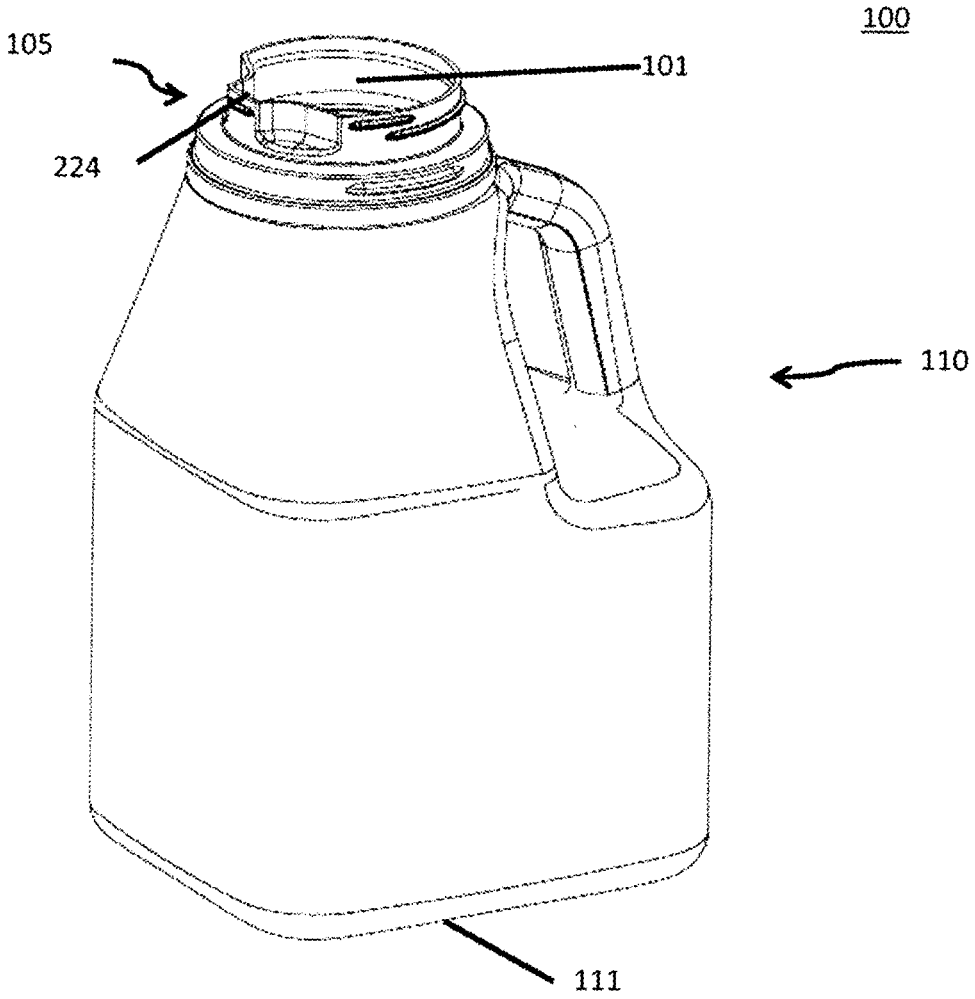
FIG. 1 is a perspective view of an exemplary plastic container in accordance with the disclosed subject matter.
Figure 2A:
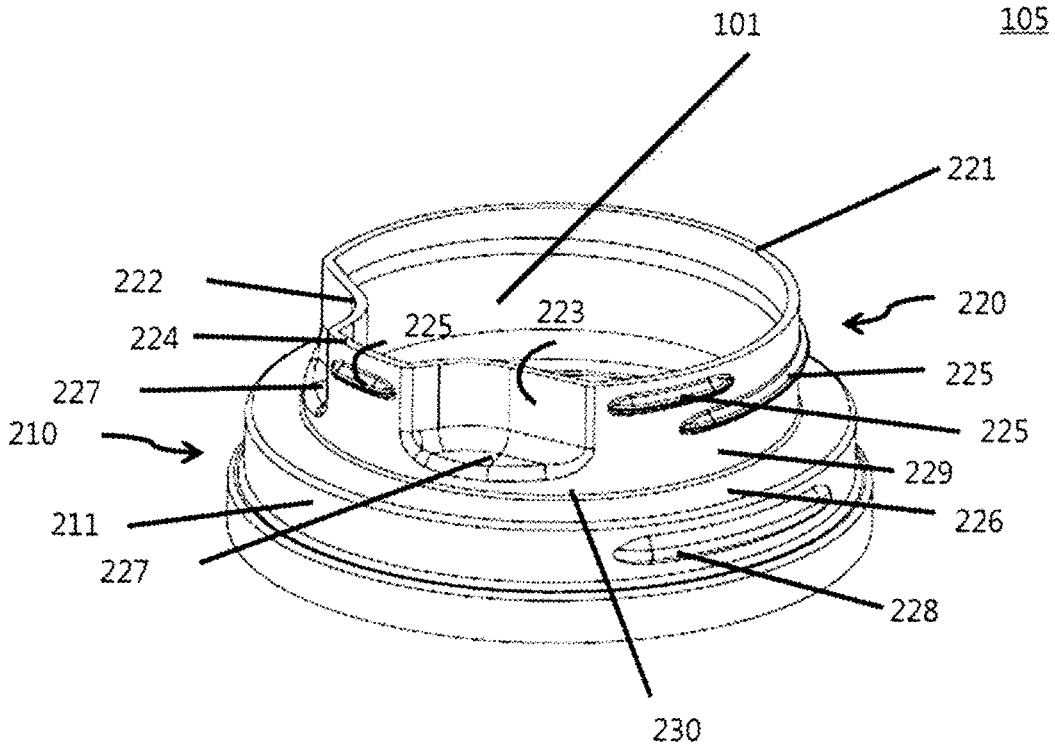
Figure 2B:
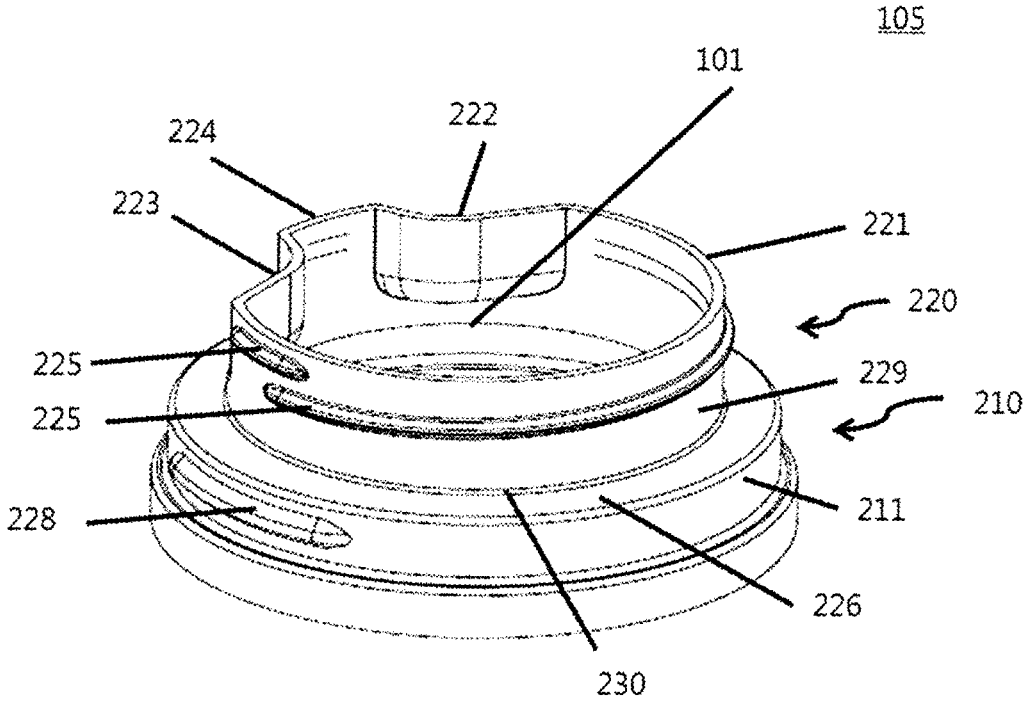
Figure 2C:
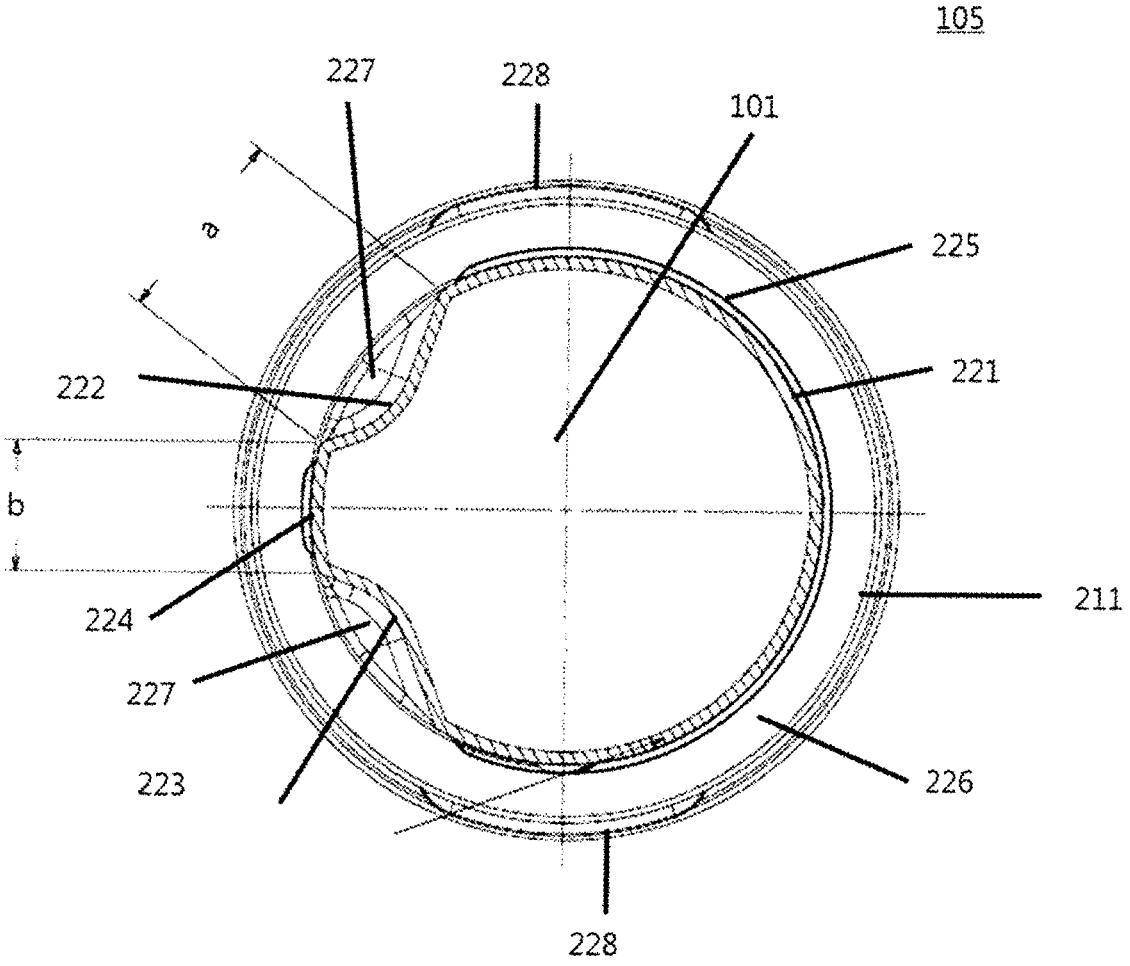
Figure 2C:
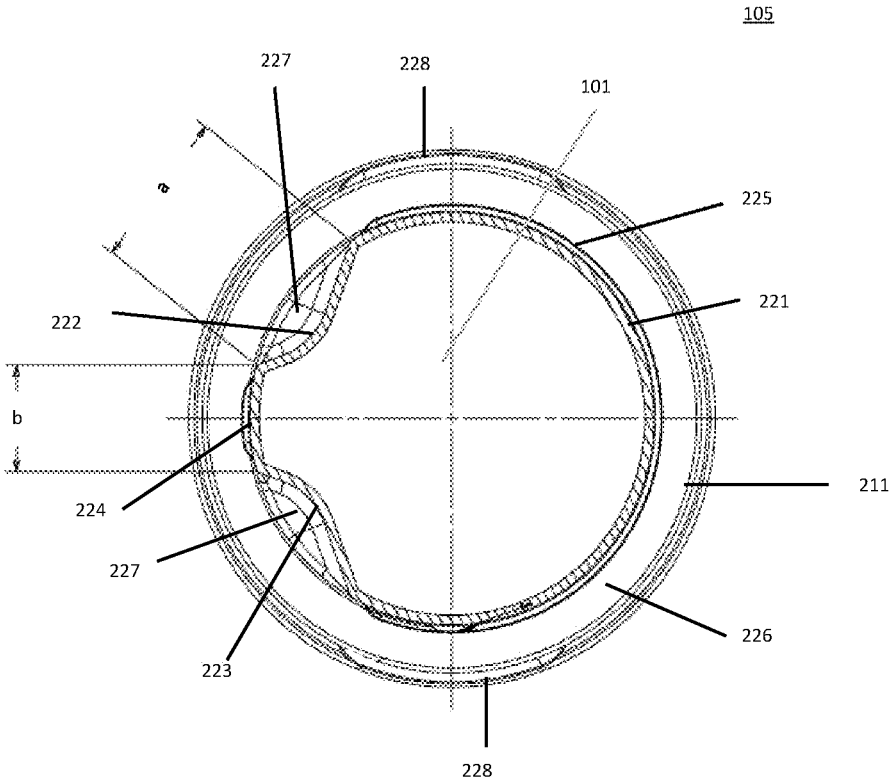
Figure 2D:
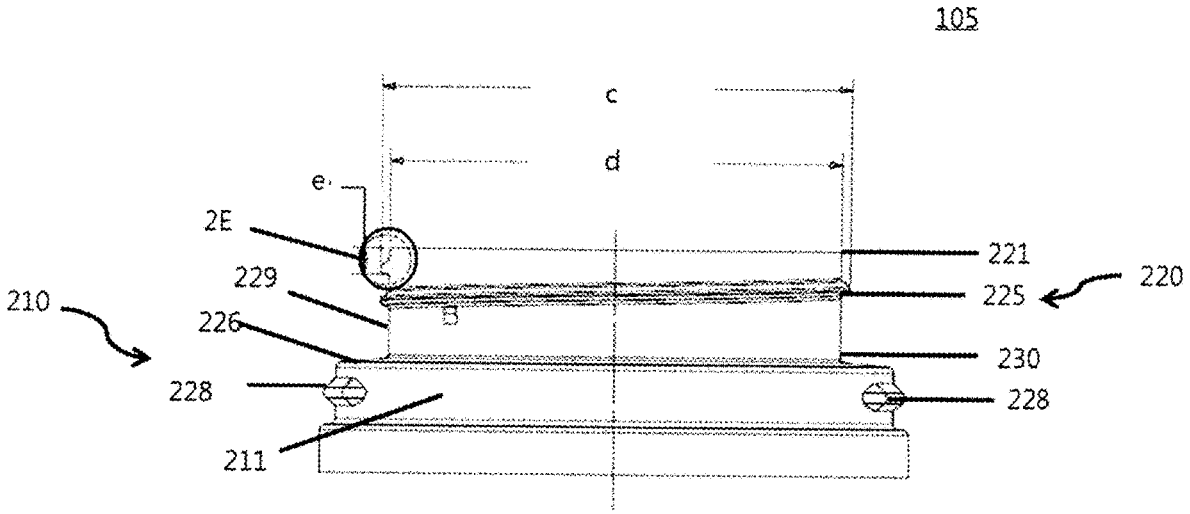
Figure 2E:
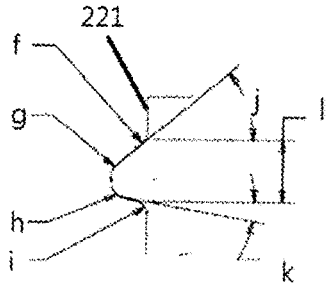
Figure 2F:
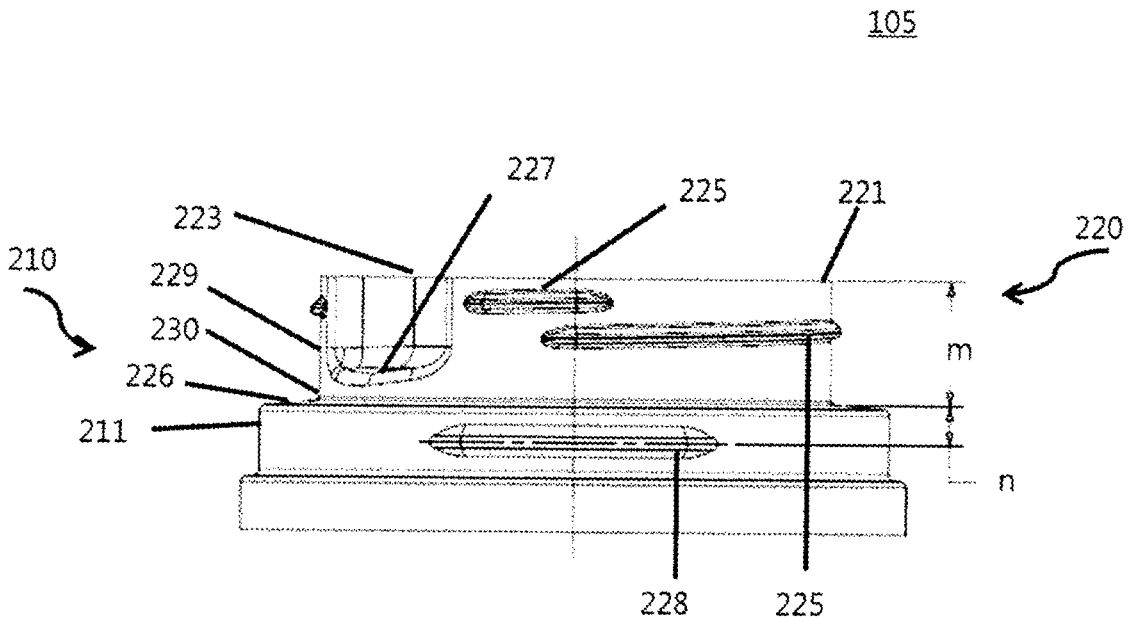
Figure 2G:
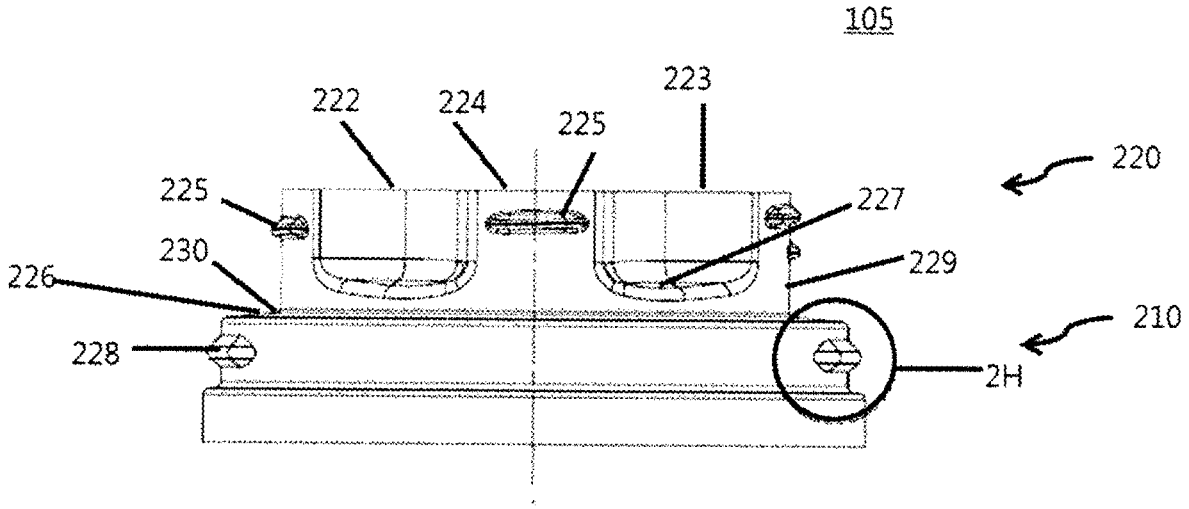
Figure 2H:
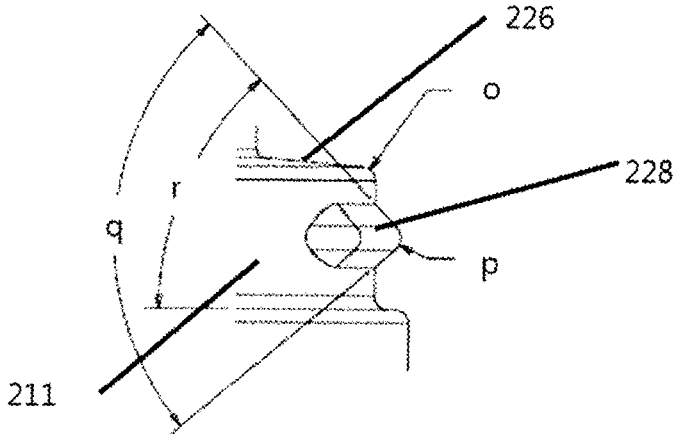

Reference will now be made in detail to embodiments of the disclosed subject matter, an example of which is illustrated in the accompanying drawings. The disclosed subject matter will be described in conjunction with the detailed description of the system.

As disclosed herein, plastic containers disclosed herein can be used to provide directional pour to dispense a liquid or flowable product to a desirable location, e.g., to a dose cup. Such liquids or flowable products can include medicines, beverages, personal hygiene products, beauty products, and household and industrial cleaning products, including detergents, solvents, disinfectants, and polishes. The plastic containers disclosed herein can also be used for storing such product while being shipped and handled with little or no leakage from the finish portion while still providing a desired directional pour. The containers disclosed herein have a finish portion with an integral spout and a flat planar surface about the entirety of the upper edge so as to allow an induction seal to be provided thereto. The container can further include ergonomic features to provide an easy removal of the induction seal. Furthermore, the configuration of the finish portion improves product evacuation from the bottle, which reduces the amount of product remaining in the container after dispensing the product and thereby eliminates waste.

In accordance with the disclosed subject matter, a plastic container providing directional pour to dispense a liquid, e.g., to a dose cup, is provided. The plastic container comprises a main body portion defining an interior space, and a finish portion defining a mouth in fluid communication with the interior space. The finish portion has an upper portion including a circumferential wall surrounding the mouth, and the circumferential wall has a lower end and an upper edge defining a height of the circumferential wall. In addition, the circumferential wall comprises a first indent and a second indent each extending inwardly into the mouth to form a spout portion disposed between the first indent and the second indent. The upper portion further comprises at least one thread disposed on the height of the circumferential wall.

The accompanying figures, where like reference numerals refer to identical or functionally similar elements throughout the separate views, serve to further illustrate various embodiments and to explain various principles and advantages all in accordance with the disclosed subject matter. Hence, features depicted in the accompanying figures support corresponding features and combinations thereof of the claimed subject matter.

Referring now to an exemplary embodiment as depicted in FIG. 1, for purpose of illustration and not limitation, a plastic container 100 includes a main body portion 110 defining an interior space, and a finish portion 105 defining a mouth 101 in fluid communication with the interior space. As embodied herein, the finish portion 105 can be unitary with the main body portion 110, and the spout portion 224 can be unitary with the finish portion. As used herein, the term "unitary" is intended to mean formed as a single piece such as by blow molding or the like.

FIGS. 2A-2H provide a series of schematic views of the finish portion 105 depicted in FIG. 1 for the purpose of illustration and not limitation.

The top of the upper portion 220 includes a circumferential wall 229 defining the mouth 101 of the container. As embodied herein, the diameter of the circumferential wall 229 can be any suitable dimension for the disclosed container, such as about 5.7 inches as embodied herein. The diameter can be between from about 1 inches and about 10 inches. The circumferential wall 229 includes a lower end 230 and an upper edge 221 defining a height of the circumferential wall 229. Further in accordance with the disclosed subject matter, the upper portion 220 comprises along the circumferential wall 229 a first indent 222 and a second indent 223, each extending inwardly into the mouth 101. A spout portion 224 is thus disposed between the first indent and the second indent. The upper portion 220 can further comprise two upper ledges 227 formed at the bottom of the first indent 222 and the second indent 223. The upper portion 220 also comprises at least one thread 225 disposed on the height of the circumferential wall which can be in generally horizontal alignment with the first indent 222 and the second indent 223. As embodied herein, having the threads 225 disposed in line with the indents 222, 223, as seen in side view, can reduce the overall height of the finish portion 105. As such, material costs can be reduced and the finish portion can fit within a dose cup. For example, and not limitation, the height of the finish portion can be calibrated to be compatible with conventional dose cups, which can further reduce manufacturing and design costs. Furthermore, the configuration of the finish portion improves product evacuation from the bottle, which reduces the amount of product remaining in the container after dispensing the product and thereby eliminates waste.

Additionally, and in accordance with the disclosed subject matter, by disposing the spout portion 225 between the indents 222, 223, the finish portion 105 can be configured with a continuous, closed-loop, flat planar surface. That is, and as depicted in the figures for illustration, the upper edge 221 of the circumferential wall 229 can be flat planar and thereby define a top surface. As embodied herein, this top surface can be parallel with the bottom portion 210 of the finish portion 105, and/or parallel with a reference plane defined by the bottom support surface 111 of the main body portion 110 (e.g., the flat planar surface can be horizontal). As such, and as will be described in further detail below, the upper edge 221, including the spout portion 225, can enable features that require a flat planar surface, such as application of an induction seal. Generally, induction seals produce superior sealing effects as compared to conventional seals such as foam liners. In accordance with the disclosed subject matter, the container can thus be provided with a finish portion that has both a directional pouring feature and an induction seal capability.

In accordance with another aspect of the disclosed subject matter, and with reference to FIGS. 2A-2H, the finish portion 105 can further comprise a bottom portion 210 such that the bottom portion 210 includes a flange surface 226 extending outwardly from the lower end 230 of the circumferential wall 229 and can extend continuously around the base of the finish portion 105. The finish portion 105 can further include an upper portion 220 disposed above the bottom portion 210. As embodied herein, the upper portion 220 can have a smaller diameter than the bottom portion 210, and can be centered with respect to the bottom portion 210. If provided, the bottom portion of the finish portion can further comprise a side wall 211 extending downward from the flange surface 226, and the flange surface 226 of the bottom portion 210 can be disposed above the side wall 211. The flange surface 226 can provide some added control in pouring liquid contents from the container. The flange surface 226 can also act as a dam to retain liquid contents, before allowing the liquid to spill or funnel into the spout portion 224. In particular, if the level of liquid content exceeds the height of the flange surface 226, the liquid content is pulled to the spout portion 224 because the flow velocity in the spout portion is higher than that of the liquid content flowing over the ledge. This differential velocity can maintain a consistent pour stream even when the bottle is tilted at higher pour angles. Furthermore, the configuration of the finish portion improves product evacuation from the bottle, which reduces the amount of product remaining in the container after dispensing the product and thereby eliminates waste.

As embodied herein, the side wall 211 can optionally include at least one retention lug 228 disposed on the outer surface of the side wall 211. The retention lug 228 can provide a surface for fitting one or more additional components to the finish portion 105. For example, and not limitation, the retention lug 228 can permit snap-fitting of an outer dose cup, such as illustrated in FIGS. 4C-4D, 5C, and 9C, which will be described in greater detail below. If desired, the outer dose cup can include metering features, and can be provided instead of a standard dose cup that is threaded onto the finish portion.

A variety of suitable configurations can be used for the indents and spout portion in accordance with the disclosed subject matter. As illustrated, for example and not limitation, in FIGS. 2A-2G, the spout portion 224 can be disposed between the first indent 222 and the second indent 223, such that the shape of the spout portion is partially defined by the shapes of the indents. For example, the indents 222, 223 can be concave and extend into the mouth 101 of the container. As illustrated in the accompanying figures, the indents 222, 223 can be curved. However, it is to be understood that the indents can have any other suitable shape. Moreover, as illustrated in the accompanying figures, the presently disclosed circumferential wall 229 comprises at least two indents 222, 223, although more than two indents can be present about the circumferential wall. For example, the circumferential wall can have at least 3 or at least 4 indents. The additional indents can be disposed about a single spout or additional spout portions and/or other pouring features can be disposed between the additional indents. Thus, the presently disclosed finish portions can include more than one pouring feature (e.g., spout portions) at least partially defined by the shapes of three or more indents. Such additional pouring features can provide alternative pouring angles for multi-directional dispensing of liquid contents from the container.

As embodied herein, the finish portion 105 can be configured such that little or no residual liquid remains in the plastic container 100 after the liquid contents are dispensed repeatedly. Advantageously, the spout portion 224 is unitary with the container, avoiding a need for a separate spout portion, or a more complex and costly process to reform geometry. As embodied herein, no separate spout portion is needed for manufacturing the plastic container 100, and the geometry of the spout portion 224 can be molded at the same time as the remainder of the container. This design can reduce the complexity and costs of manufacturing the plastic bottle and potentially reduces likelihood of leakage through a seam because there is no seam between the single piece spout portion 224 and finish portion 105.

Figure 3A:
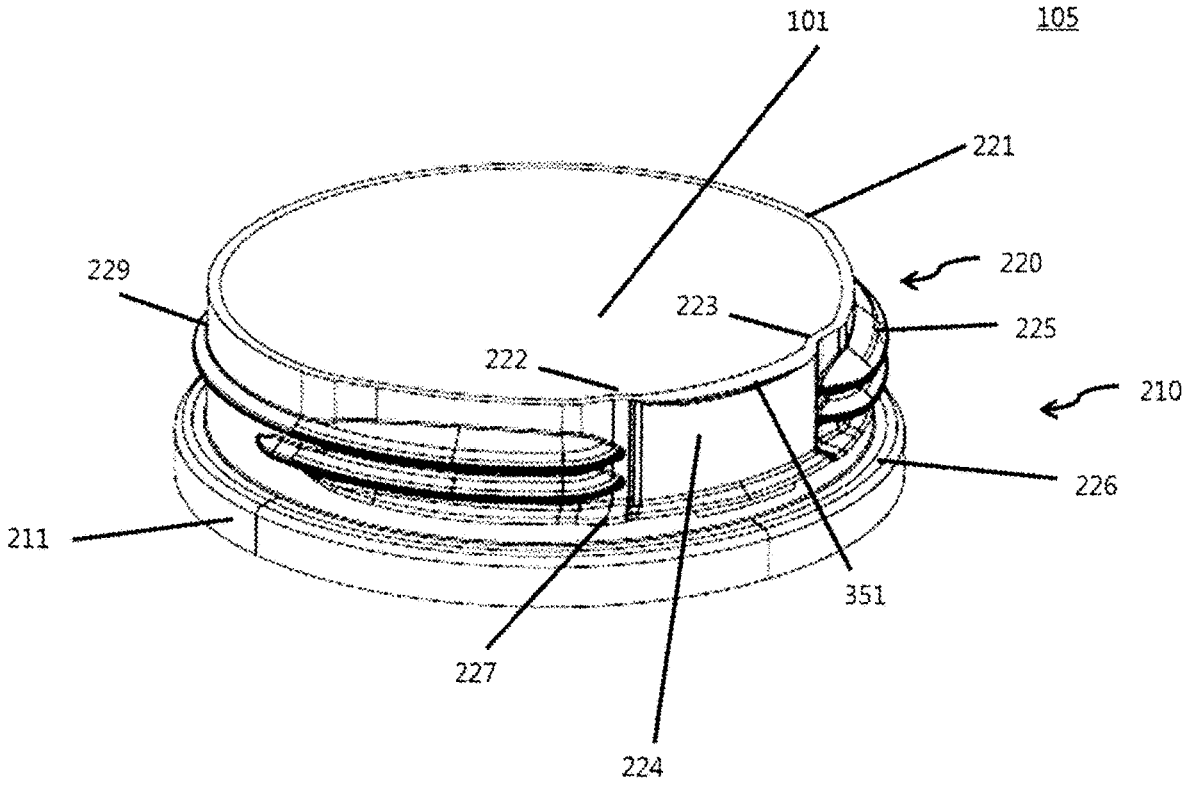
FIGS. 3A-3C are schematic view of an exemplary embodiment of the finish portion of a plastic container disclosed herein having a lip extending outwardly from its spout portion. Particularly.
Figure 3B:
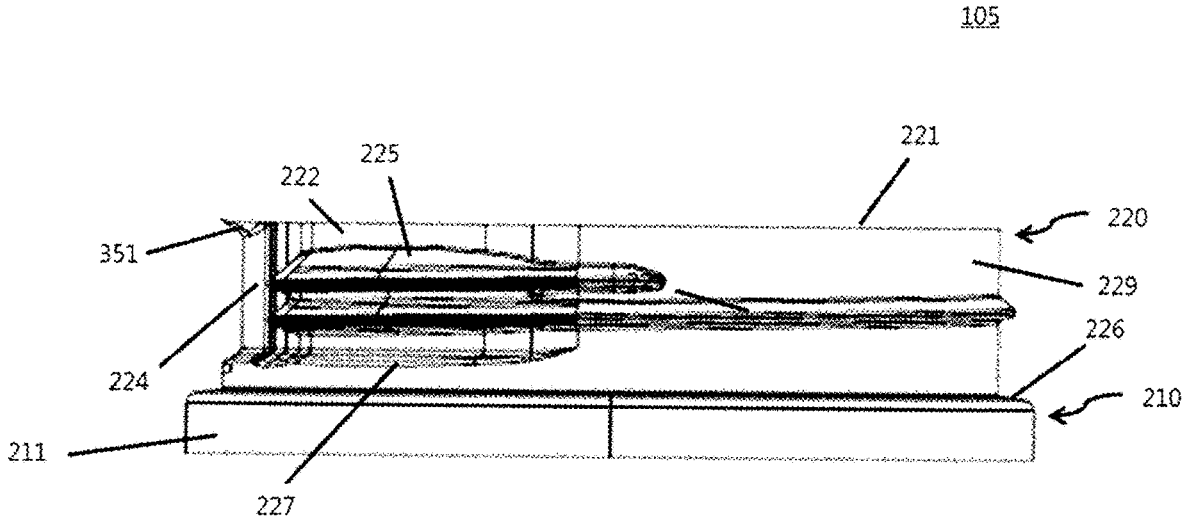
Figure 3C:
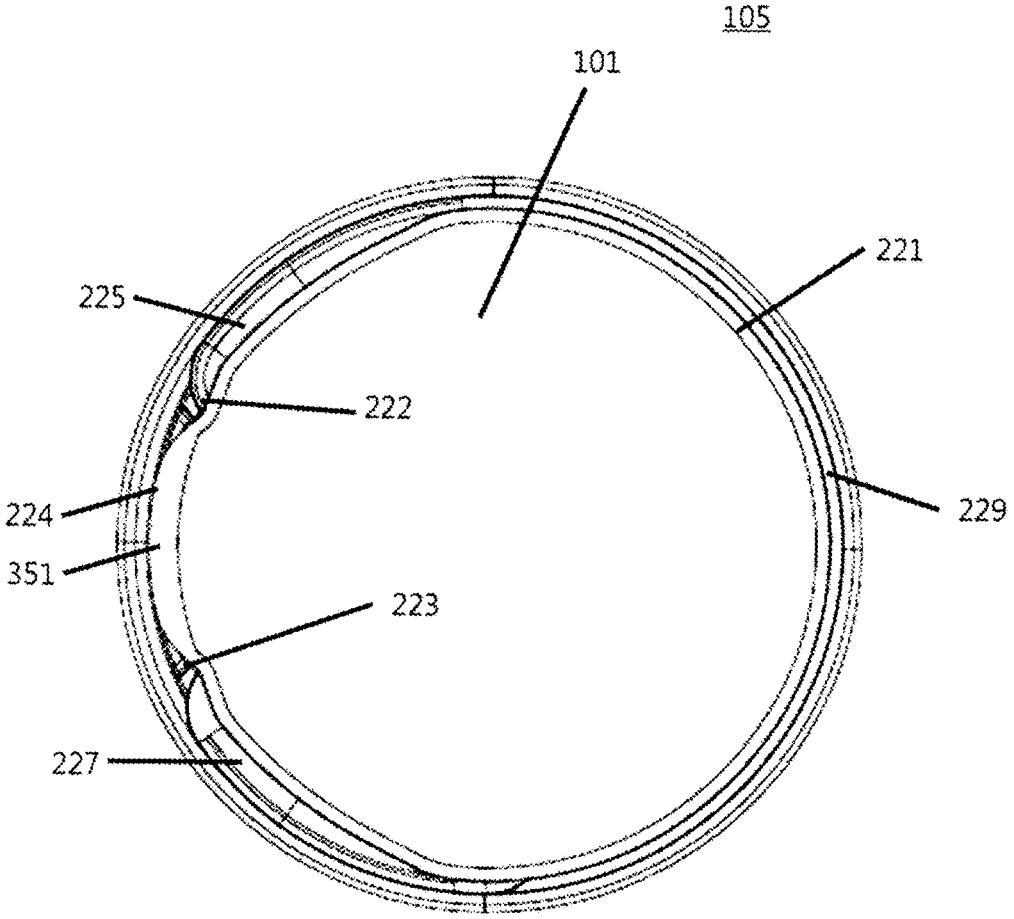

Additionally or alternatively, and as embodied herein, the spout portion can optionally include a lip to control and cut off the flow of liquid when liquid is dispensed. For example, and as embodied herein, the lip can ensure that excess product does not flow down the exterior of the spout portion and pool outside of the circumferential wall of the finish portion. For the purpose of example and not limitation, FIGS. 3A-3C depict an exemplary finish portion 105 of a plastic container having a lip 351 on the spout portion 224. The lip can extend from the circumferential wall 229 and outward from the mouth 101 of the container at the spout portion 224. The lip 351 can be angled relative to the circumferential wall 229 such that the angle of the lip 351 is greater than horizontal when the container is tipped to its minimum pouring angle (e.g., when the container is tipped to about 45° from vertical). In this manner, flow can be cut off by the lip 351 when the container is returned to an upright position from its dispensing position because liquid product will be blocked from flowing along the spout portion 224. Additionally and as shown in the embodiment of FIGS. 3A-3C, the circumferential wall 229 can be smooth (i.e., unthreaded) at the spout portion 224 such that any excess or dried product can be easily wiped or scraped away from the finish portion if it flows down the exterior of the circumferential wall 229.

Figure 4A:
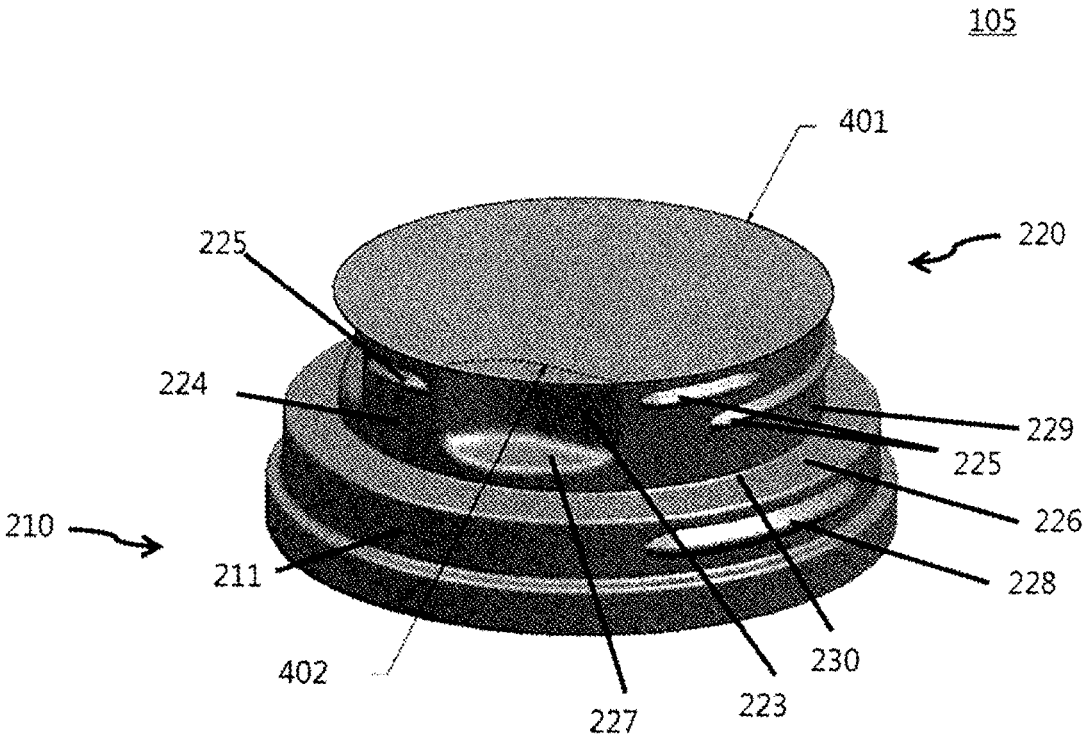
Figure 4B:
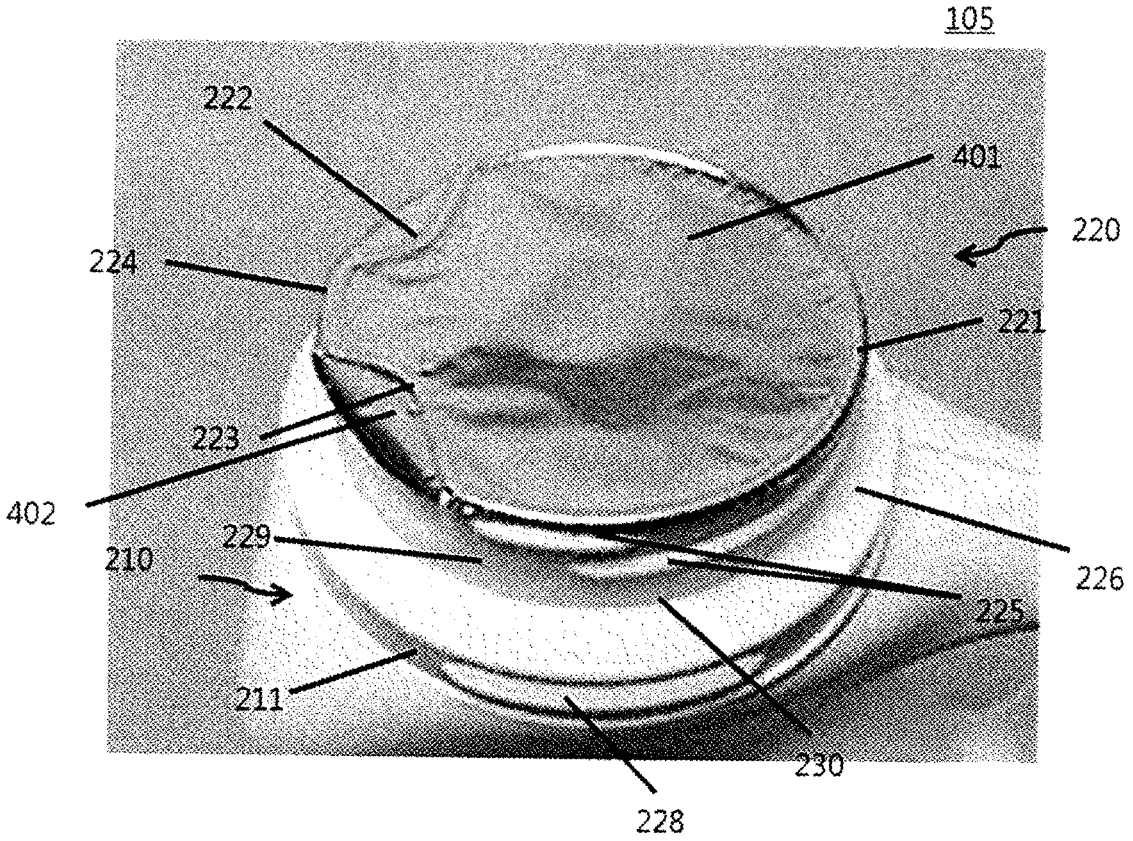

In accordance with the disclosed subject matter and as noted above, a finish portion 105 with a flat planar upper edge surface can further include an induction seal 401. Traditionally, an induction seal cannot be used with a standard spout, which has a contorted or nonplanar top surface. By contrast, the induction seal 401 can be supported by a upper edge 221 defining a continuous, closed-loop flat planar surface, as previously described. FIGS. 4A-4B depict, for the purpose of illustration not limitation, an exemplary finish portion 105 of a plastic container, where a flat planar induction seal 401 is adjacent to the mouth 101. In this manner, an induction seal can be used rather than a traditional compression foam cap liner. The rim of the induction seal 401 can be in line or extend beyond the upper edge 221 of the upper portion 220. As embodied herein, the size of the induction seal 401 can be less than or approximately equal to the size of the flange surface 226. As a result, the current subject matter, disclosing a finish portion with unitary spout portion which has a flat planar top surface, is suitable for applying induction seals, thereby providing a robust seal. For the purpose of illustration not limitation, the induction seal 401 can extend over the first indent 222 and/or the second indent 223 to define a grab area or tab for the induction seal 401. Traditional induction seals can sometimes be difficult to remove due to small area of pull tabs. The container in the disclosed subject matter with unitary spout portion 234 creates the exposed area 402 that allows the induction seal 401 to be easily grasped and removed by consumers. In addition, this induction seal configuration saves seal material and manufacturing costs since no additional pull tab is necessary to remove the induction seal 401. A person of ordinary skill in the art will appreciate that, although not depicted, the finish portions illustrated in FIGS. 2A-21H, 3A-3D, 5A-5C, 6A-6B, 7A-7B, 8A-8C, and 9A-9C can also include a cap and/or induction seal, similar to those of FIGS. 4A-4D.

Figure 4C:
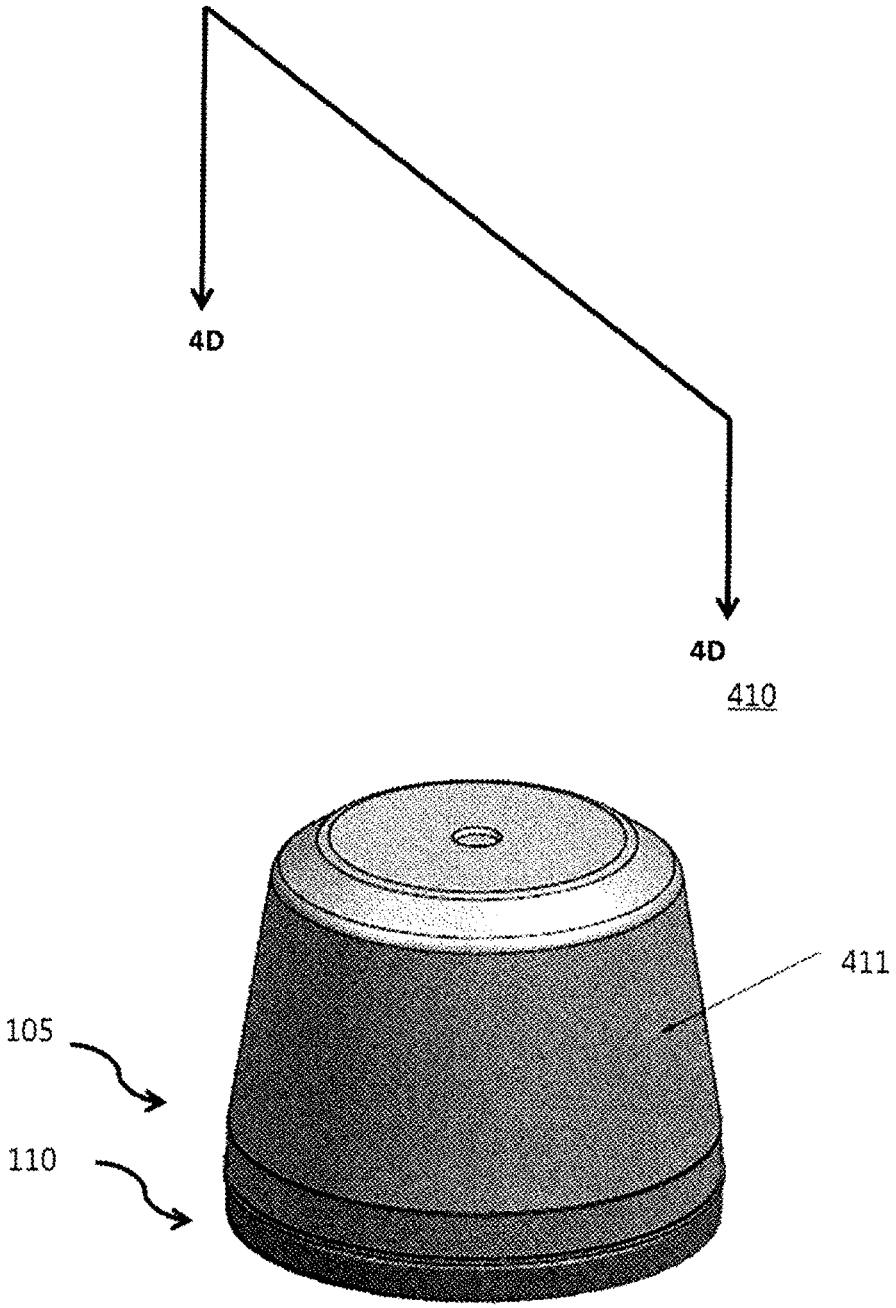
Figure 4D:
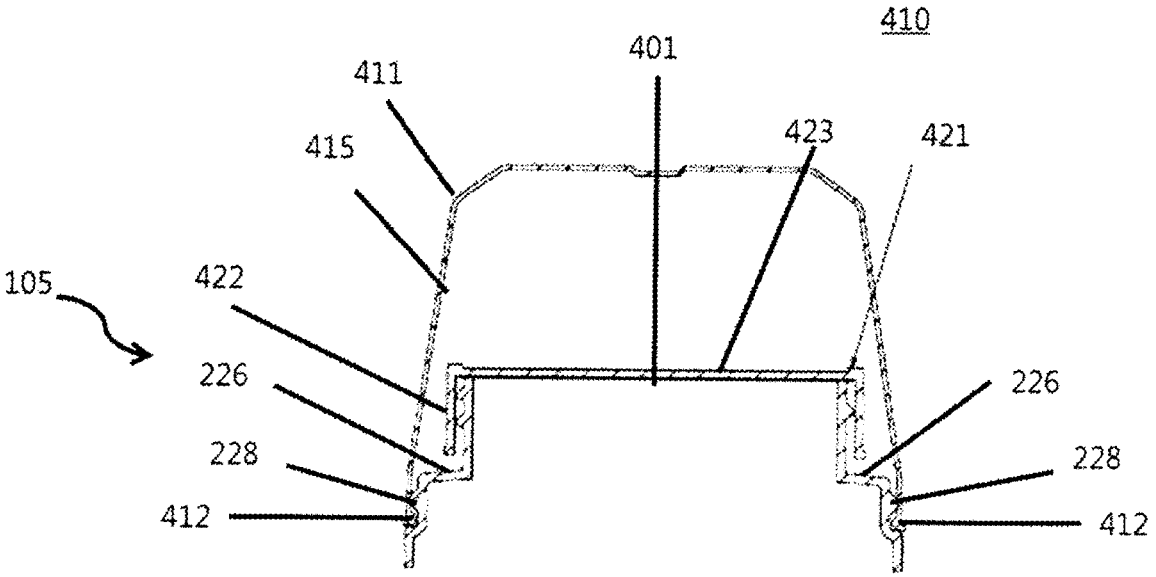

As further embodied herein, a cap such as an overcap can be provided to cover the induction seal. Additionally and/or alternatively, an inner cap can be used over the induction seal. The inner cap can be used during the sealing process of applying the induction seal and removed, or maintained in position if desired. As such, overcap and/or inner cap can provide a secondary barrier to the induction seal, e.g., during shipping, and can be replaced on the container after initial use to provide a seal after consumer removes the induction seal. FIGS. 4C-4D depict, for the purpose of illustration not limitation, a finish portion 105 engaged with the overcap 411 and the induction seal 401 forming a capped finish portion 410 disposed above the main body portion 110.

With reference to FIG. 4D, one or more internal clips 412 (e.g., protrusions, ribs, etc.) can be provided at the lower portion of the internal surface of the overcap 411 to engage the retention lugs 228, and provide a snap-fitting of the overcap 411 to the finish portion 105. As embodied herein, the overcap 411 can be disposed to cover the induction seal 401 and, if present, an inner cap 421, so as to wholly enclose the induction seal 401 and inner cap 421. Alternatively, the inner cap 421 can be only partly enclosed within the overcap 411. As embodied herein, the overcap 411 can be provided with measuring marks or indicia in the side wall 415, so as to allow the overcap to be used as a dose cup for dispensing liquid. Additionally or alternatively the inner cap 421 can have measuring marks or indicia in the side wall, which enables it to be used as a dose cup for dispensing liquid. The measuring marks or indicia can be printed, stamped, carved, or otherwise placed on the side wall 415.

As embodied herein, the inner cap 421, if provided, can be attached to the finish portion 105 directly. The outer portion 422 of the inner cap 421 can engage the threads 225 and be disposed directly over the induction seal 401. The inner cap 421 can be integrated with the induction seal 301 during the manufacturing process. For example, the induction seal 401 can be placed inside the inner cap 421 before the inner cap 421 is applied over the mouth 101 of the container 100. After the plastic container 100 has been filled and capped with the inner cap 421, the sealing process takes place which releases the induction seal 401 from the inner cap 421 and creates a bond with upper edge 221 of the upper portion 220 resulting in a hermetically sealed product. If desired or needed, the inner cap 421 can further include a secondary liner (e.g., a pull back liner) to prevent leakage after the induction seal is removed. The space between the upper flat planar surface of the upper portion 220 and the inner surface of the top platform 423 of the inner cap 421 can thus be configured to provide a seal against leakage once the induction seal is removed. In addition, a gasket seal can be disposed on the ledges 227 to fill the gap between the bases of the cap and the ledge 227 of the finish portion 105. Alternatively or additionally, the inner cap 421 can further include tamper-evidence features such as a plastic ring or tab that will rupture upon initial removal of the inner cap from the container.

Although FIG. 4D illustrates an exemplary container including an induction seal, an inner cap and an overcap, a person of ordinary skill in the art will appreciate that a container can be provided with only one or two of these features. For example, a container in accordance with the disclosed subject matter can be provided only an induction seal and an overcap, and no inner cap. Alternatively, only an inner cap can be provided on the finish portion of the disclosed subject matter, or an induction seal and an inner cap can be provided with an overcap provided separately.

In accordance with the embodiments of the subject matter previously described, the components of the induction seal 401 can be made out of any suitable material. For example, the induction seal 401 can be formed of suitable paper, foil, polymer film, or a combination thereof, and sealed to the flat planar upper edge surface on the finish portion using known techniques.

In accordance with another aspect of the disclosed subject matter, the at least one thread 225 at the upper portion 220 of the finish portion 105 can be provided with a variety of configurations, such as interrupted or continuous threads. Generally, each thread has a helical configuration to allow engagement with a corresponding inner thread. FIGS. 5A-5B, 6A-6B, 7A-7B, 8A-8D, and 9A-9C depict, for the purpose of illustration but not limitation, exemplary embodiments with various thread and indent configurations. A person of ordinary skill in the art would appreciate that any existing caps in the art that are used with conventional containers, can be used with the spout design with directional pour in the disclosed subject matter, as illustrated without limitation in FIGS. 5A-5B, 6A-6B, 7A-7B, 8A-8D, and 9A-9C.

Figure 5A:
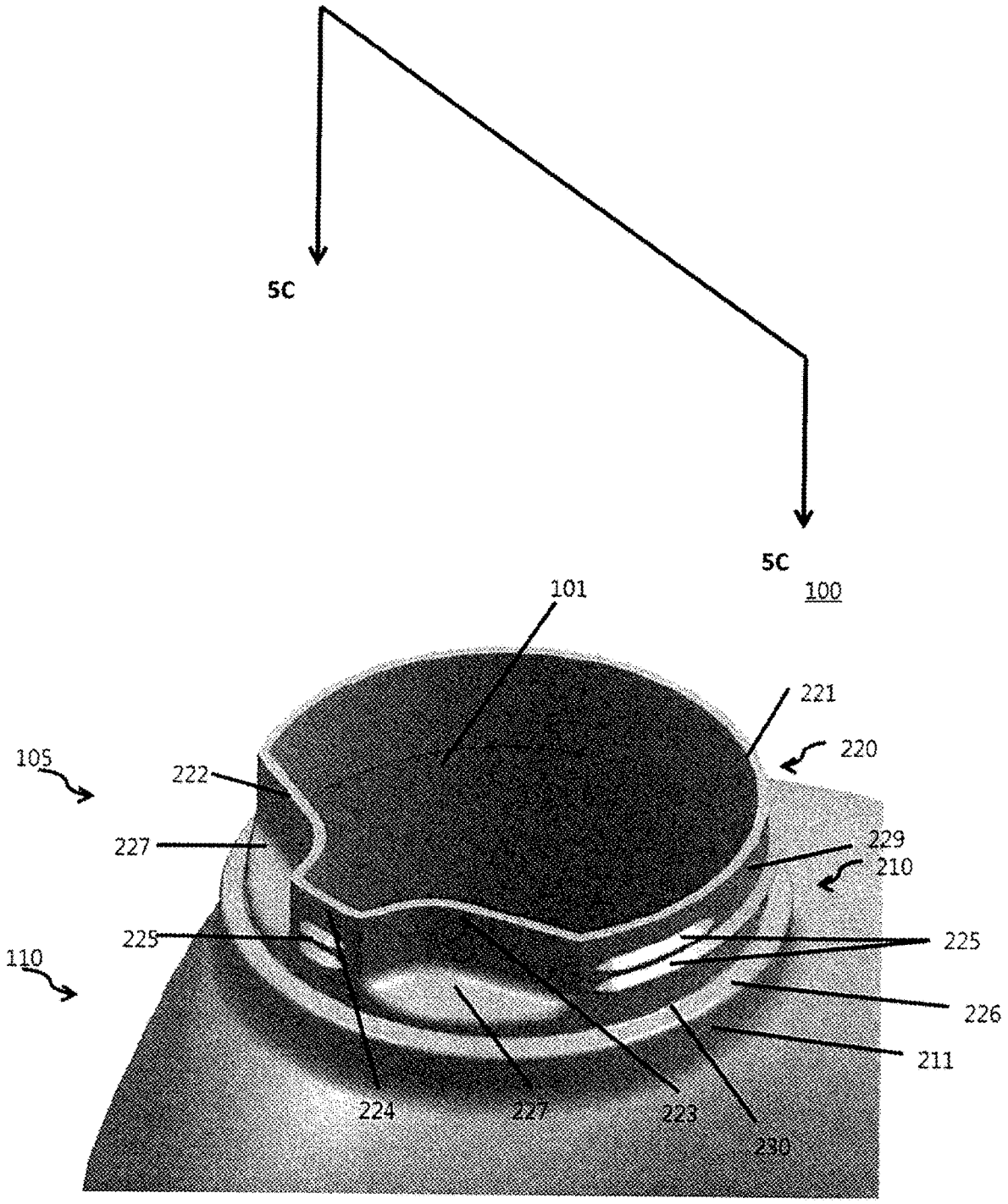
FIGS. 5A-5B are schematic views of an exemplary embodiment of the finish portion of a plastic container disclosed herein, wherein the thread is interrupted about the circumferential wall and no portion of the thread is disposed within the indent. Particularly.
Figure 5B:
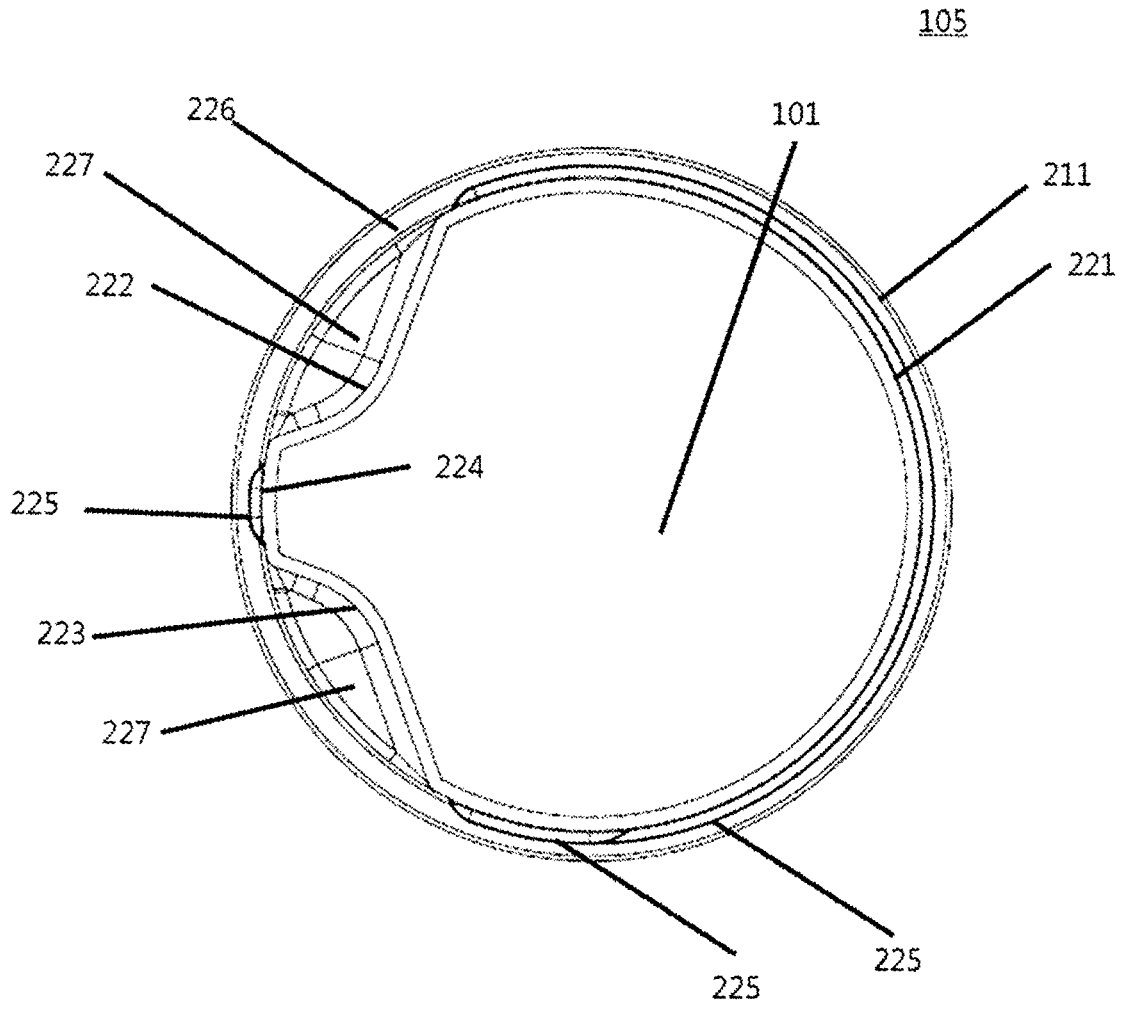

FIGS. 5A-5B depict, for the purpose of illustration not limitation, an exemplary finish portion 105 of a plastic container. As shown in FIGS. 5A-5B, the threads 225 can be interrupted. Additionally, the threads 225 can be configured such that the indents 222, 223 are free of any portion of the at least one thread 225. A portion of the threads 225 can be disposed on the spout 224. Such configuration can provide continuous hold along the upper portion 220 for a cap (not pictured) to attach to the finish portion 105 along the threads 225. Plastic containers are particularly suited for use with interrupted threads. Indeed, as would be understood by a person of ordinary skill in the art, interrupted threads are not feasible with certain other materials, such as glass, because it is not possible to form such detailed geometry when manufacturing containers from these materials.

Figure 5C:
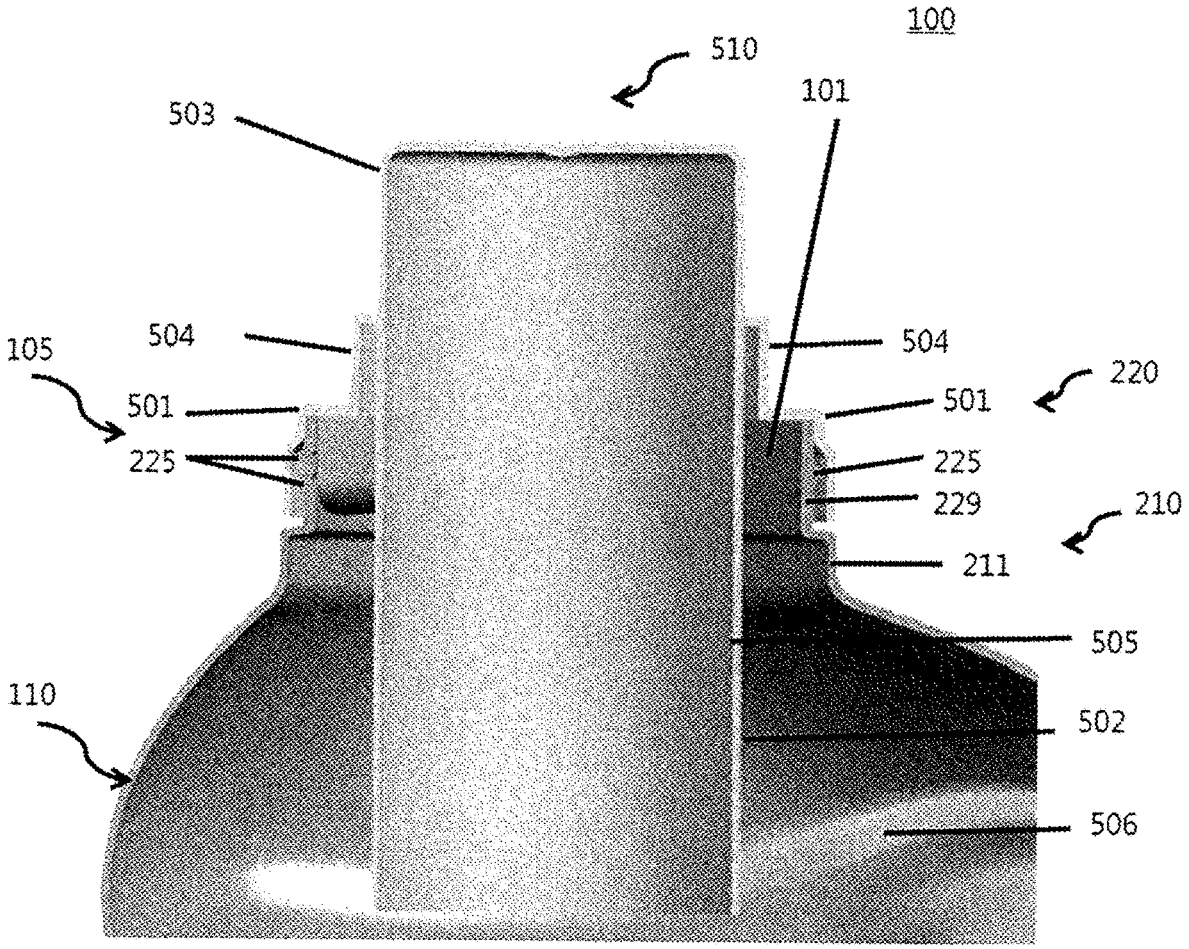
FIG. 5C is a cross-sectional side view taken along the plane defined by line 5C-5C of FIG. 5A, with a dose cap attached to the exemplary finish portion of FIG. 5A.

FIG. 5C provides a cross-sectional side view taken along the plane defined by line 5C-5C of FIG. 5A. As illustrated in FIG. 5C, a cap 510 can be attached to the finish portion 105 by the threads 225. As embodied herein, the cap 510 can include a bottom outer portion 501 and an inner hollow portion 502. The bottom outer portion 501 is provided with at least one inner thread to engage at least one thread 225 of the finish portion 105. The inner hollow portion 502 is configured to extend through the mouth when the cap 510 is attached to the finish portion 105. The cap 510 can further include a middle outer flange 504, extending around the cylindrical member 502 disposed above the bottom outer flange 501. A portion of the cylindrical member 502 can form an enclosed cylindrical top 503 above the bottom outer flange 501 and the middle outer flange 504. When the cap 510 is engaged with the container 100, the enclosed cylindrical top 503 can extend above the mouth 101 of the container.

As previously noted, the inner hollow portion 502 can have measuring marks or indicia disposed on its side wall 505. Such measuring marks or indicia can enable the cap 510 to be used as a dose cup for dispensing liquid. The measuring marks or indicia can be printed, stamped, carved, or otherwise placed on the side wall 505.

Figure 6A:
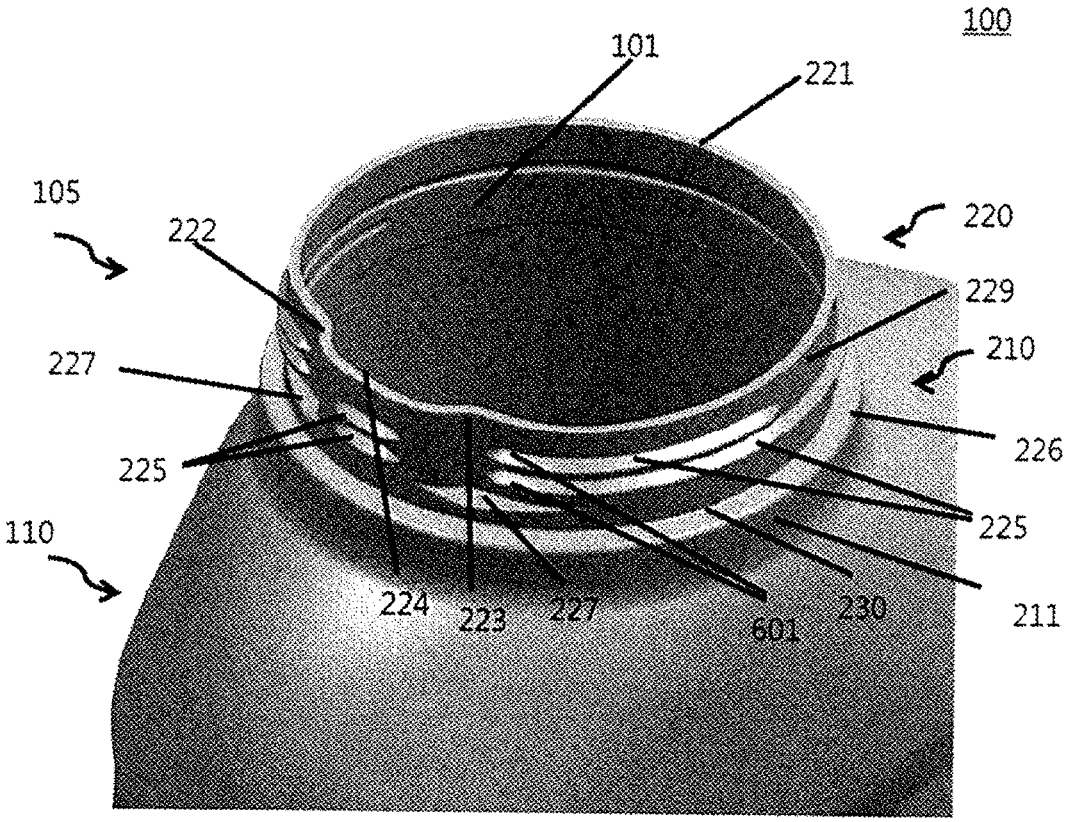
FIGS. 6A-6B are schematic views of another exemplary embodiment of the finish portion of a plastic container disclosed herein, wherein the thread is interrupted and a portion of the threads is disposed with the indents. Particularly.
Figure 6B:
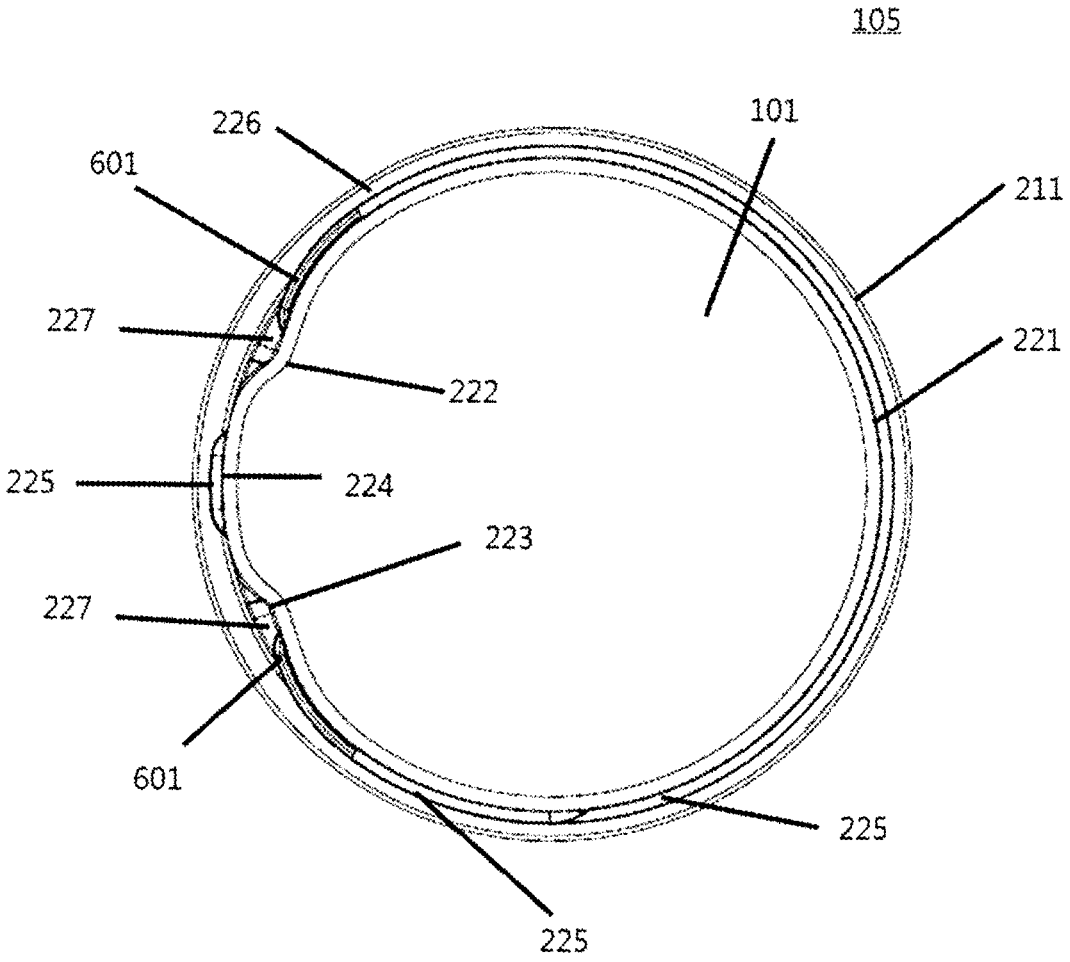

FIGS. 6A-6B depict, for the purpose of illustration and not limitation, another exemplary finish portion 105 of a plastic container 100. As illustrated in FIGS. 6A-6B, the threads 225 can be interrupted along the circumferential wall 229 of the upper portion 220, and a portion 601 of the threads can be disposed within at least a portion of the first indent 222 and/or second indent 223. Although it is possible to engage a cap without having threads 225 within the indents 222, 223, providing threads within at least a portion of one or more of the indents can provide a more secure hold when a cap is engaged on the container.

Figure 7A:
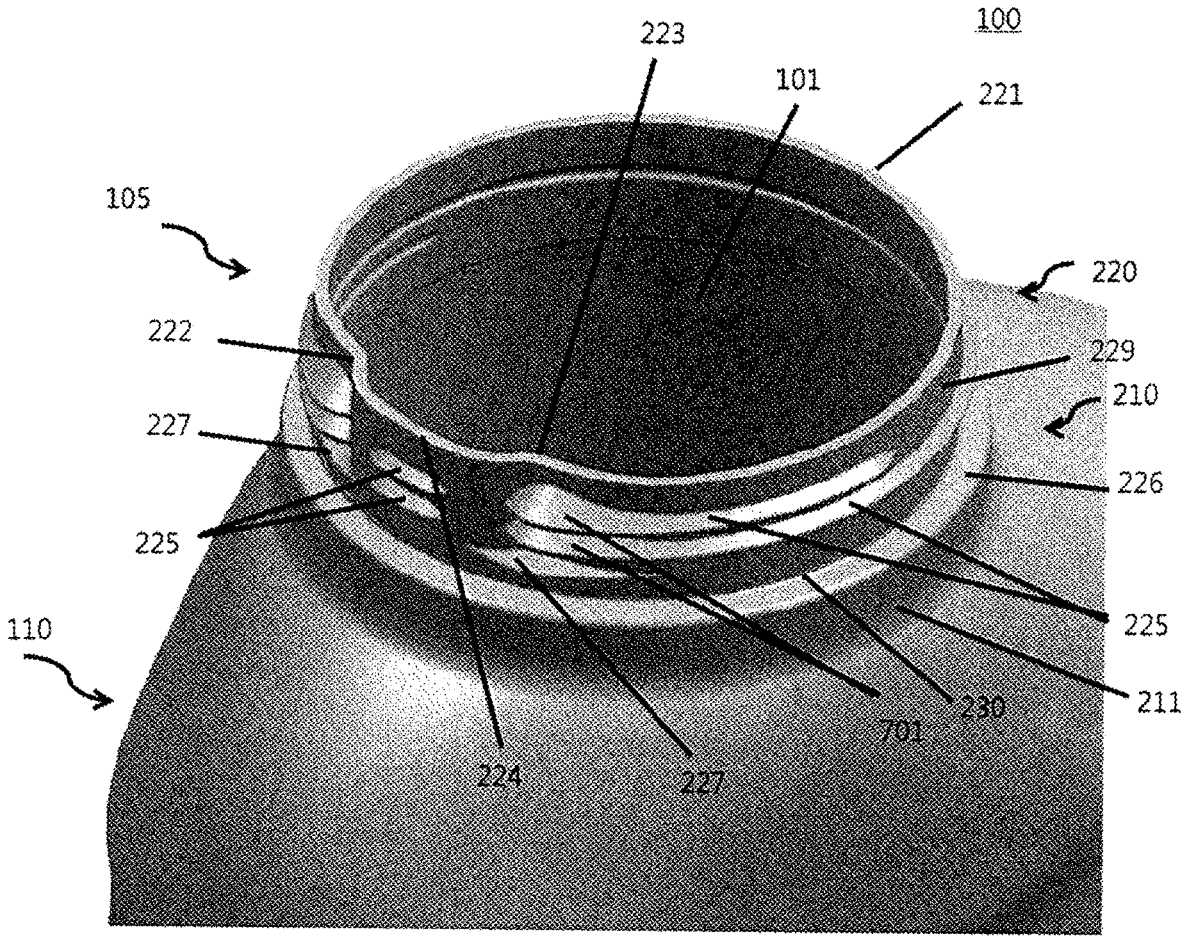
FIGS. 7A-7B are schematic views of another exemplary embodiment of the finish portion of a plastic container disclosed herein, wherein the thread is interrupted and a portion of the thread is disposed on the indents.
Figure 7B:
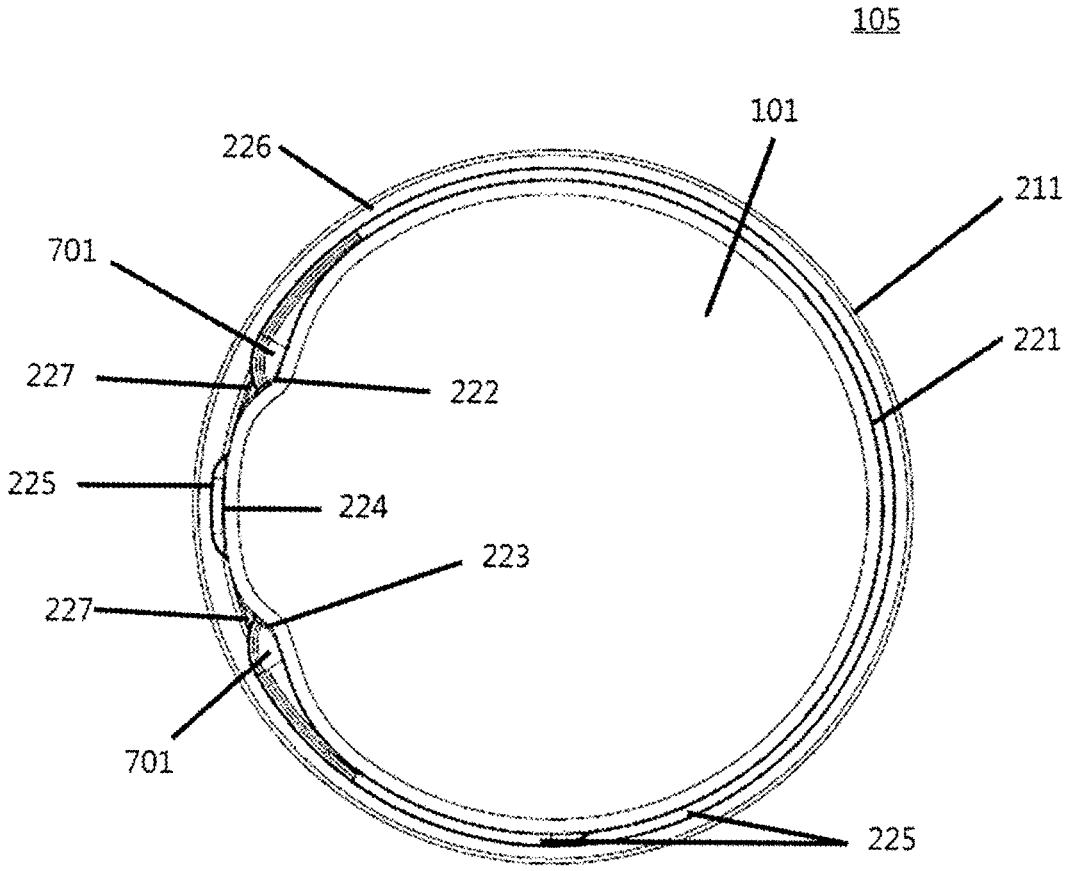

Alternatively, as illustrated for example and not limitation in FIGS. 7A-7B, a larger portion 701 of the threads 225 can be disposed within a portion of the first indent 222 and/or the second indent 223. Increasing the surface area of thread 225 along the upper portion 220 of the finish portion 105, for example, by increasing the portion of the thread extending into the first and second indents can increase the security of the hold when a cap is engaged on the container.

Figure 8A:
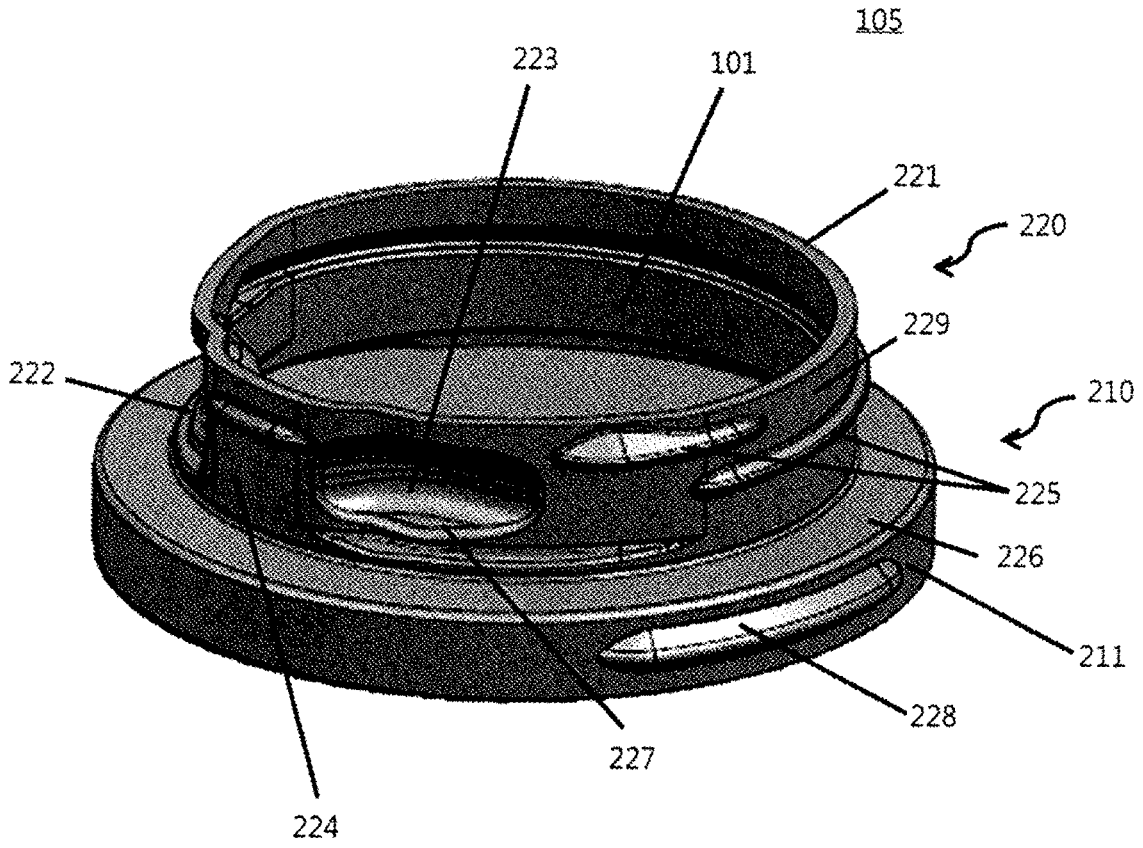
FIGS. 8A-8C are schematic view of another exemplary embodiment of the finish portion of a plastic container disclosed herein, wherein the thread is interrupted and the indents do not extend to and are not adjacent to the upper edge of the circumferential wall.
Figure 8B:
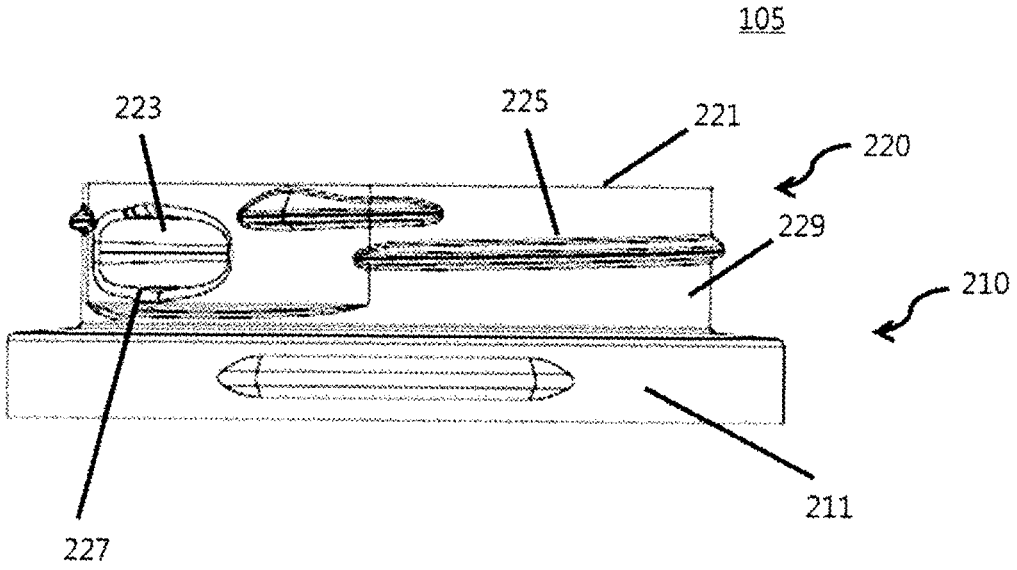
Figure 8C:
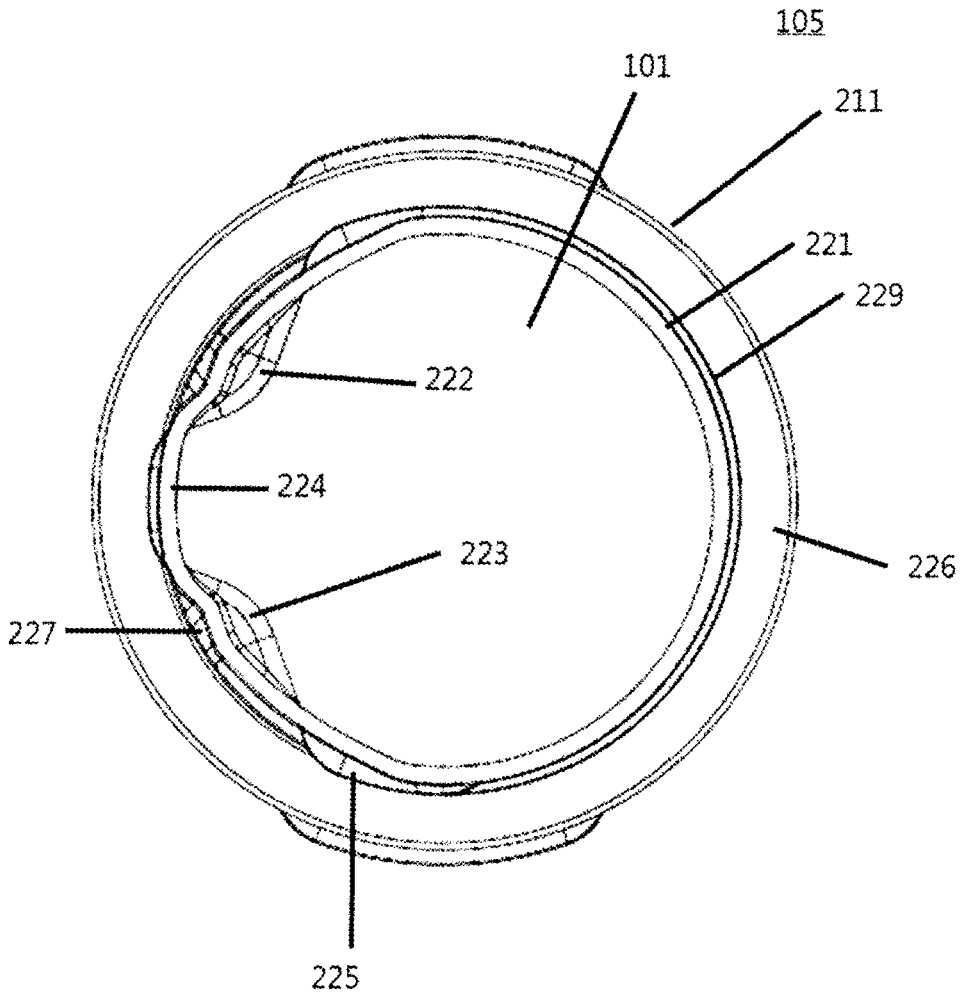
Figure 8D:
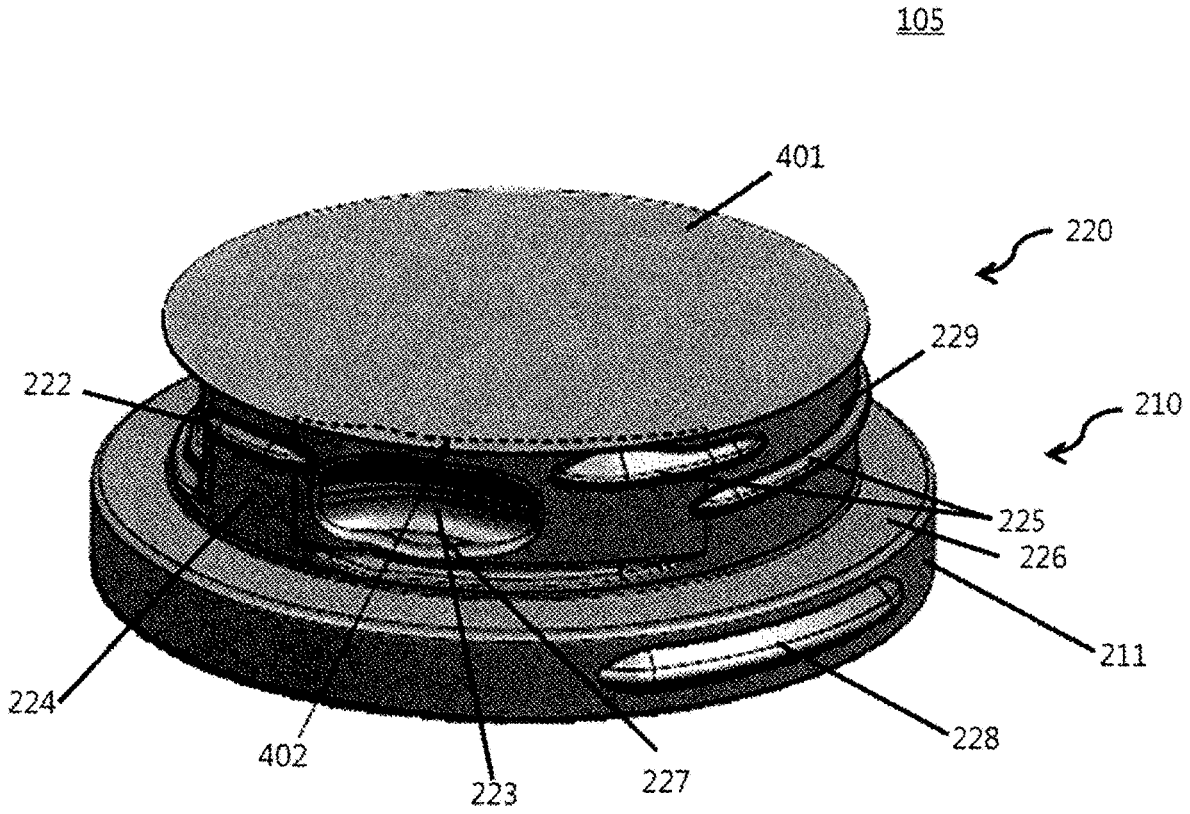
FIG. 8D is a schematic perspective view of the finish portion depicted in FIGS. 8A-8C having an induction seal attached to flat planar upper edge surface of the finish portion.

FIGS. 8A-8C depict, for the purpose of illustration and not limitation, an exemplary finish portion 105 of a plastic container wherein the thread is interrupted and the indents 222, 223 do not extend to and are not adjacent to the upper edge 221 of the circumferential wall 229. Thus, in the embodiment depicted in FIGS. 8A-8C, the shape of the upper edge 221 of the circumferential wall 229 is not defined by the curvature of the indents 222, 223. As compared to other finish portions of the disclosed subject matter, e.g., those depicted in FIGS. 2A-2H and 4A-4B, the closed-loop planar surface of the upper edge 221 is more circular and therefore more similar in shape to a conventional surface for an induction seal. For example, FIG. 8D depicts such a finish portion with an induction seal 401 in place. By having a more circular shape, the planar surface of the upper edge 221 can provide an improved secondary seal (i.e., when the induction seal is removed and a cap placed on the threads 225). As embodied herein, a slight curvature can be present at the upper edge and in-line with the indentations to create an exposed area 402 of the induction seal 401 and provide a surface for gripping and removing the induction seal.

Figure 9A:
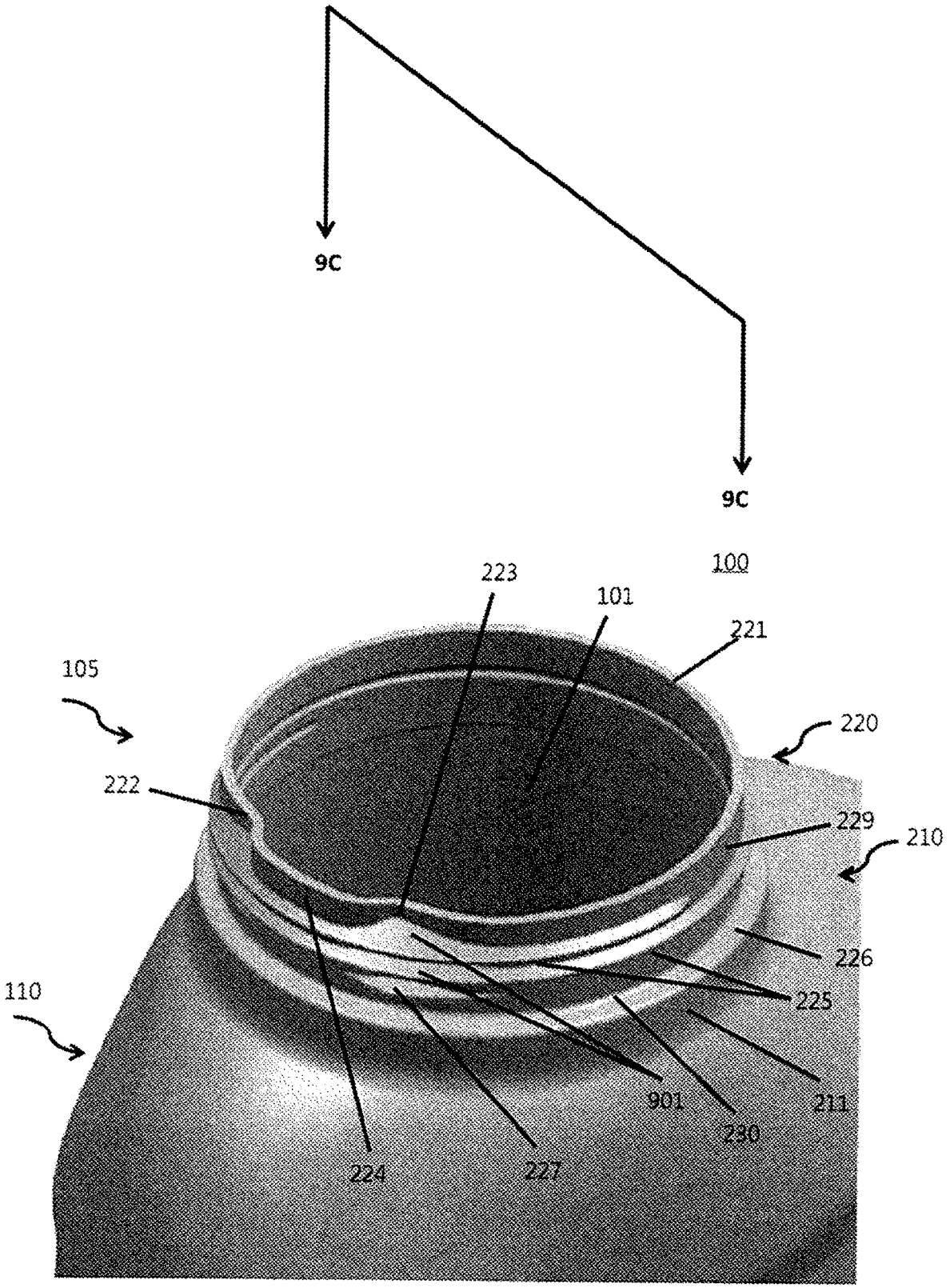
FIGS. 9A-9B are schematic views of yet another exemplary embodiment of the finish portion of a plastic container disclosed herein, wherein the thread extends continuously about an entirety of a circumference of the circumferential wall of the upper portion. Particularly.
Figure 9B:
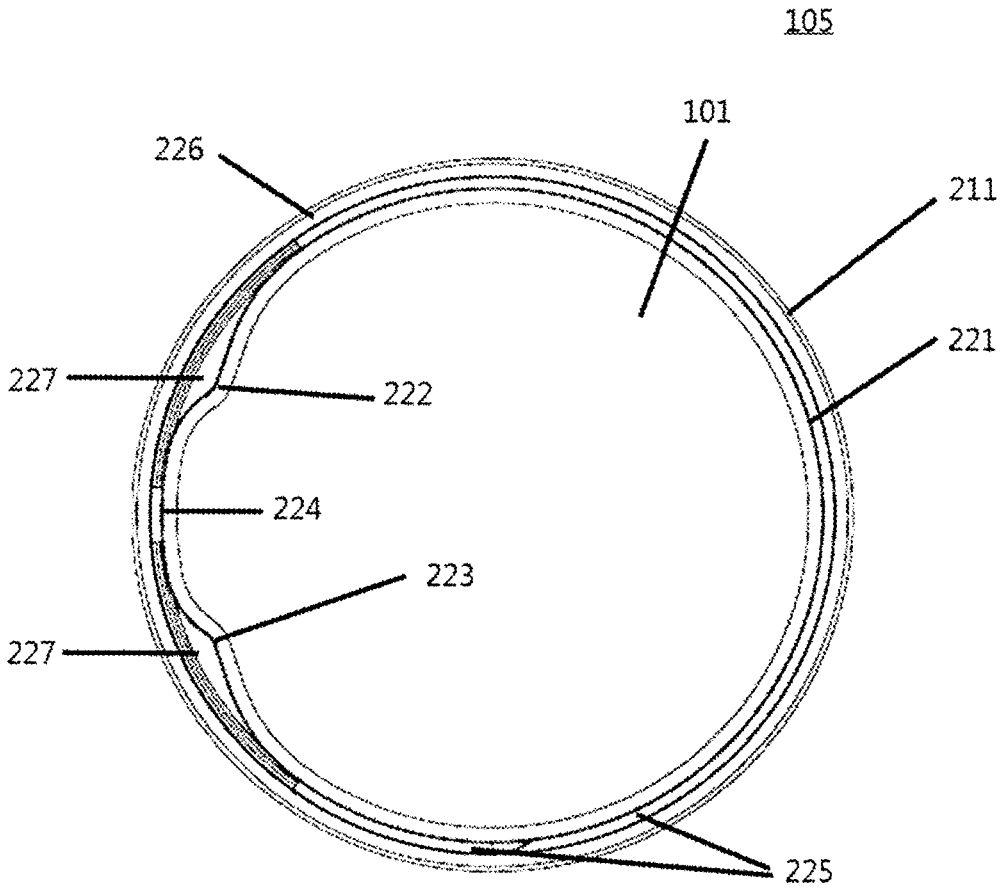
Figure 9C:
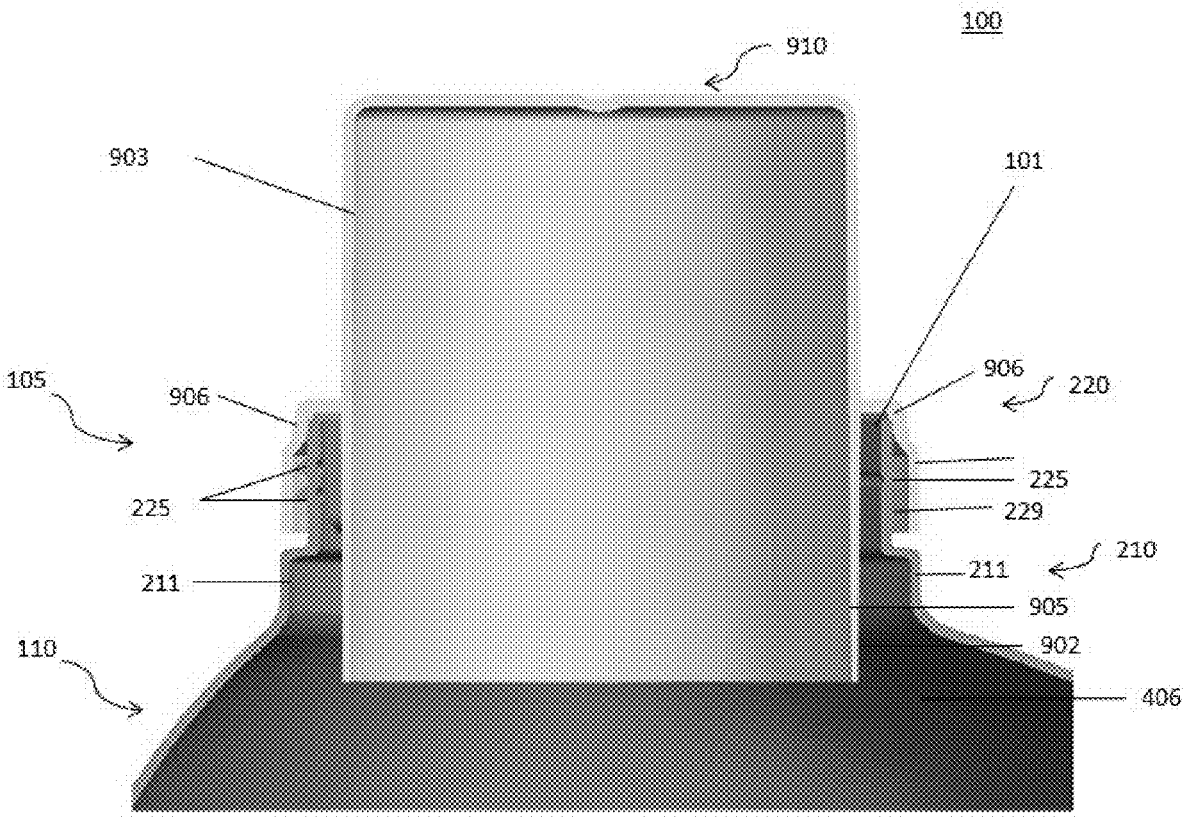
FIG. 9C is a cross-sectional side view taken along the plane defined by the line 9C-9C of FIG. 9A, with a dose cap attached to the exemplary finish portion of FIG. 9A.

FIGS. 9A-9B depict, for the purpose of illustration not limitation, an exemplary finish portion 105 of a plastic container 110, wherein at least one thread extends continuously about an entirety of a circumference of the circumferential wall 229 of the upper portion 220. As such, a portion 901 of the threads 225 extends within the first indent 222 and the second indent 223. Additionally, at least one thread 225 extends within the spout portion 224 to connect the portion 601 of the thread located within the indents 222, 223. FIG. 9C is a cross-sectional side view taken along the plane defined by line 9C-9C of FIG. 9A, with a cap 910 attached to the exemplary finish portion of FIG. 9A by threads 225. As described above in connection with FIG. 4D, the cap 910 can include an outer portion 906 and an inner hollow portion 902. As depicted in FIG. 9B, the height of the inner hollow portion 902 can vary, depending on the desired application. For example, the height of the inner hollow portion can be used to calibrate the volume of a dose cup. A portion of the inner hollow portion 902 extends above the outer portion 906 and forms an enclosed cylindrical top 903. As described above, the cap 910 can have measuring marks or indicia on its side wall 905. The measuring marks or indicia can be printed, stamped, carved, or otherwise placed on the side wall 905. A person of ordinary skill in the art will appreciate that, although not depicted, the finish portions illustrated in FIGS. 6A-6B, FIGS. 7A-7B, and FIGS. 8A-8D can also include a cap, similar to those of FIGS. 5C and 9C.

For purpose of illustration, and not limitation, the dimensions of an exemplary finish portion will now be described in detail. These dimensions will be described with reference to the finish portion 105 illustrated in FIGS. 2A-2H. Regarding the thread development, in certain embodiments, 63 mm single lead is developed with interruption at the indents 222 and 223. The threads also have 6.00 TPI per lead, 0.167 pitch, 360° turn of thread per lead, and cutter diameter of 0.500 in. For convenience, other selected dimensions depicted in FIGS. 2A-2H are reproduced in Table 1 below for purpose of illustration and not limitation.

TABLE 1

Exemplary dimensions of the finish portion 105.

| Dimension | Example |
|---|---|
| Width of the indents 222/223 (a) | 0.90 in |
| Width of the spout portion 224 (b) | 0.61 in |
| Diameter of the upper portion 220 (c) | 2.35 in |
| Diameter of the threads 225 (d) | 2.44 in |
| Height between the top of the upper portion 220 and the bottom of the upper thread 225-1(e) | 0.14 in |
| Radius of the upper connector between upper edge 221 and thread 225-1 (f) | 0.02 in |
| Radius of the upper portion of the thread 225-1 (g) | 0.02 in |
| Radius of the lower portion of the thread 225-1 (h) | 0.03 in |
| Radius of the lower connector between upper edge 221 and thread 225-1 (i) | 0.02 in |
| Angle of the upper portion the thread 225-1 (j) | 40° |
| Ange of the lower portion of the thread 225-1 (k) | 10° |
| Height of the thread 225-1 (l) | 0.08 in |
| Height of the top portion 220 (m) | 0.58 in |
| Height of the bottom portion 210 (n) | 0.18 in |
| Radius of the upper rim of the bottom portion 210 (o) | 0.03 in |
| Radius of the rim of the retention lug 228 (p) | 0.04 in |
| Angle between the upper cut and lower cut of the retention lug 228 (q) | 87° |
| Angle between the upper cut of the retention lug 228 and the bottom of the bottom portion 210 (r) | 47° |

Although these dimensions are provided for one embodiment of the disclosed subject matter, a person of ordinary skill in the art would understand that the exemplary dimensions presented herein can be revised as needed or desired.

Furthermore, the configuration of the finish portion improves product evacuation from the bottle, which reduces the amount of product remaining in the container after dispensing the product and thereby eliminates waste. That is, it was demonstrated that the container of the disclosed subject matter with the spout portion configured as described herein provided a surprising improvement in product evacuation as compared with conventional two-piece container-and-spout configurations. For example, seven commercially-available plastic containers existing in the market were tested against three plastic containers having integrated spouts, as disclosed herein, for product evacuation capacity. The plastic containers were tested for evacuation of water. Each container was filled with water, then the water was dispensed through the spout. The volume of water remaining in the container after evacuation was measured to determine each container's product evacuation capacity. These results are presented in Table 2.

TABLE 2

Product evacuation capacity of plastic containers existing in the market as compared to plastic containers with integrated spout.

| | Plastic container (uses or container volume oz) | Spout Design (types or upper portion diameter mm) | Remaining Product Volume (cc) |
|---|---|---|---|
| Existing Plastic Container | 100 oz-1 | Push-in | 45 cc |
| | 40 Use | Push-in | 18 cc |
| | 66 oz | Push-in | 47 cc |
| | 75 oz-1 | Push-in | 30 cc |
| | 75 oz-2 | Capped Spout | 6 cc |
| | 100 oz-2 | Push-in | 41 cc |
| | 150 oz | Push-in | 98 cc |
| Containes with Integrated Spout | 50 oz | 63 mm diameter | 0 cc |
| | 75 oz | 70 mm diameter | 1 cc |
| | 150 oz | 70 mm diameter | 3 cc |

The results show that plastic containers having an integrated spout on the finish portion, as configured and disclosed herein, provide better product evacuation capacity than two-piece plastic containers existing in the market. As illustrated in Table 2, the 50, 75, and 150 oz. containers with integrated spouts all had less volume of water remaining after dispensing than any of the commercially-available plastic containers. As such, the presently disclosed plastic containers can have improved product evacuation, thereby eliminating waste and improving product dispensing.

As embodied herein, and for purpose of illustration and not limitation, the container can be formed using any suitable method, as known in the art. For example, and with reference to FIG. 1, the finish portion 105 together with the container body 110 can be blow-molded. For purpose of example, and not limitation, the mold can have two halves, divided along the spout portion (i.e., along the "line of draw"). Thus one indent can be disposed on each half of the mold. Additionally, because the finish portion 105 is unitary with the main body portion 110, and the spout portion 224 is unitary with the finish portion, the spout geometry can be blown at the same time as the rest of the container geometry. The top edge and seams of the container can then be trimmed of excess material after blow-molded. This method can save additional operations and costs, which would be otherwise incurred when a separate spout component is assembled to a blown container.

While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the devices of the disclosed subject matter without departing from the spirit or scope of the disclosed subject matter. Thus, it is intended that the disclosed subject matter include modifications and variations that are within the scope of the appended claims and their equivalents.

What is claimed is:

1. A plastic container, comprising:

(a) a main body portion defining an interior space; and (b) a finish portion defining a mouth in fluid communication with the interior space, the finish portion having an upper portion including a circumferential wall surrounding the mouth, the circumferential wall having a lower end and an upper edge defining a height of the circumferential wall, the circumferential wall comprising a first indent and a second indent each extending inwardly into the mouth to form a spout portion disposed between the first indent and the second indent, each of the first indent and the second indent having a ledge at a bottom thereof, the upper portion further comprising at least one thread disposed on the height of the circumferential wall;

wherein at least a portion of the at least one thread is disposed on the spout portion between the first indent and the second indent.

2. The plastic container of claim 1, wherein the finish portion is unitary with the main body portion.

3. The plastic container of claim 1, wherein the upper edge defines a flat planar surface about an entirety of the circumferential wall.

4. The plastic container of claim 3, further comprising an induction seal secured to the upper edge of the circumferential wall.

5. The plastic container of claim 4, wherein the induction seal extends over at least one of the first indent and the second indent so as to expose a lower surface of the induction seal.

6. The plastic container of claim 1, wherein finish portion further includes a bottom portion, the bottom portion including a flange surface extending outwardly from the lower end of the circumferential wall.

7. The plastic container of claim 6, further comprising a cap removably attached to the finish portion by the at least one thread on the circumferential wall, the cap having a bottom edge configured for engagement with the flange surface.

8. The plastic container of claim 6, wherein the bottom portion of the finish portion further comprises a sidewall extending downwardly from the flange surface.

9. The plastic container of claim 6, wherein the sidewall of the bottom portion includes at least one retention lug.

10. The plastic container of claim 9, further comprising an overcap removably attached to the finish portion by at least one retention lug.

11. The plastic container of claim 10, further comprising a cap attached to the finish portion by at least one thread and disposed within the overcap.

12. The plastic container of claim 1, wherein the first indent and the second indent are free of any portion of the at least one thread.

13. The plastic container of claim 1, wherein at least a portion of the at least one thread is disposed on the first indent or the second indent.

14. The plastic container of claim 1, wherein the at least one thread extends continuously about an entirety of a circumference of the circumferential wall of the upper portion.

15. The plastic container of claim 1, wherein the at least one thread is interrupted along the circumferential wall of the upper portion.

16. The plastic container of claim 1, wherein the spout portion comprises a lip extending outwardly from the circumferential wall.

17. The plastic container of claim 1, further comprising a dose cap configured to be removably attached to the finish portion, the dose cap comprising an outer portion with at least one inner thread to engage the at least one thread of the finish portion, and an inner hollow portion configured to extend through the mouth when the dose cap is attached to the finish portion.

18. A plastic container, comprising:

(a) a main body portion defining an interior space; and (b) a finish portion defining a mouth in fluid communication with the interior space, the finish portion having an upper portion including a generally circumferential wall surrounding the mouth, the circumferential wall having an upper edge defining a continuous, closed-loop flat planar surface, the circumferential wall comprising a first indent and a second indent each extending inwardly into the mouth to form a spout portion disposed between the first indent and the second indent;

wherein the upper portion further comprises at least one thread disposed along a height of the circumferential wall between and in horizontal alignment with the first indent and the second indent, wherein the at least one thread is interrupted along the circumferential wall of the upper portion.

19. A blow molded plastic container, comprising:

(a) a main body portion defining an interior space; and (b) a finish portion defining a mouth in fluid communication with the interior space, the finish portion having an upper portion including a generally circumferential wall surrounding the mouth, the circumferential wall having an upper edge defining a continuous, closed-loop flat planar surface, the circumferential wall comprising a first indent and a second indent each extending inwardly into the mouth to form a spout portion disposed between the first indent and the second indent;

wherein the upper portion further comprises at least one thread disposed along a height of the circumferential wall between and in horizontal alignment with the first indent and the second indent, and wherein the main body portion and the finish portion are formed as a single-piece blow molded article.

* * * * *